US007464034B2

(12) United States Patent
Kawashima et al.

(10) Patent No.: US 7,464,034 B2
(45) Date of Patent: Dec. 9, 2008

(54) VOICE CONVERTER FOR ASSIMILATION BY FRAME SYNTHESIS WITH TEMPORAL ALIGNMENT

(75) Inventors: Takahiro Kawashima, Hamamatsu (JP); Yasuo Yoshioka, Hamamatsu (JP); Pedro Cano, Barcelona (ES); Alex Loscos, Barcelona (ES); Xavier Serra, Barcelona (ES); Mark Schiementz, Barcelona (ES); Jordi Bonada, Barcelona (ES)

(73) Assignees: Yamaha Corporation, Hamamatsu-shi (JP); Pompeu Fabra University, Barcelona (ES)

( * ) Notice: Subject to any disclaimer, the term of this patent is extended or adjusted under 35 U.S.C. 154(b) by 362 days.

(21) Appl. No.: 10/951,328

(22) Filed: Sep. 27, 2004

(65) Prior Publication Data

US 2005/0049875 A1 Mar. 3, 2005

Related U.S. Application Data

(62) Division of application No. 09/693,144, filed on Oct. 20, 2000, now Pat. No. 6,836,761.

(30) Foreign Application Priority Data

Oct. 21, 1999 (JP) ..... 11-300268
Oct. 21, 1999 (JP) ..... 11-300276

(51) Int. Cl.
*G10L 13/06* (2006.01)

(52) U.S. Cl. ..... 704/266; 704/260; 704/272; 704/246; 704/249

(58) Field of Classification Search ..... 704/266, 704/249, 246, 260, 272
See application file for complete search history.

(56) References Cited

U.S. PATENT DOCUMENTS

| | | | | | |
|---|---|---|---|---|---|
| 5,307,442 | A | * | 4/1994 | Abe et al. | 704/270 |
| 5,327,521 | A | * | 7/1994 | Savic et al. | 704/272 |
| 5,450,522 | A | | 9/1995 | Hermansky et al. | 704/200.1 |
| 5,750,912 | A | * | 5/1998 | Matsumoto | 84/609 |
| 5,847,303 | A | | 12/1998 | Matsumoto | 84/610 |
| 5,890,110 | A | | 3/1999 | Gersho et al. | 704/222 |
| 5,963,903 | A | * | 10/1999 | Hon et al. | 704/254 |
| 5,963,907 | A | | 10/1999 | Matsumoto | 704/270 |
| 6,006,186 | A | | 12/1999 | Chen et al. | |
| 6,304,846 | B1 | * | 10/2001 | George et al. | 704/270 |
| 6,311,153 | B1 | | 10/2001 | Nakatoh et al. | 704/216 |
| 6,336,092 | B1 | * | 1/2002 | Gibson et al. | 704/268 |
| 6,358,055 | B1 | * | 3/2002 | Rothenberg | 434/185 |
| 6,446,039 | B1 | * | 9/2002 | Miyazawa et al. | 704/255 |
| 6,463,412 | B1 | * | 10/2002 | Baumgartner et al. | 704/246 |
| 6,581,030 | B1 | | 6/2003 | Su | 704/219 |

* cited by examiner

*Primary Examiner*—Richemond Dorvil
*Assistant Examiner*—Qi Han
(74) *Attorney, Agent, or Firm*—Pillsbury Winthrop Shaw Pittman LLP

(57) ABSTRACT

A voice converting apparatus is constructed for converting an input voice into an output voice according to a target voice. The apparatus includes a storage section, an analyzing section including a characteristic analyzer, a producing section, a synthesizing section, a memory, an alignment processor, and target decoder.

41 Claims, 22 Drawing Sheets

FIG. 12

| | PHONEME | NUMBER OF STATES |
|---|---|---|
| VOWEL | a | 3 |
| | e | 3 |
| | i | 3 |
| | o | 3 |
| | u | 3 |
| NASAL | m | 3 |
| | n | 3 |
| | N | 3 |
| PLOSIVE | p | 2 |
| | b | 2 |
| | g | 2 |
| | d | 2 |
| | t | 2 |
| | k | 2 |
| FRICATIVE | s | 3 |
| | sh | 3 |
| | h | 3 |
| | z | 3 |
| | ch | 3 |
| | ts | 3 |
| ROLLED | r | 3 |
| LATERAL | l | 3 |
| SEMIVOWEL | w | 3 |
| | y | 3 |
| DOUBLE CONSONANT | Q | 3 |
| OTHERS | ASPIRATION | 2 |
| | SILENCE | 1 |

FIG. 13

PROBABILITY DATA

PNONEME SILENCE

PNONEME i

PNONEME e

PNONEME a

STATE TRANSITION PROBABILITY

| $a_{11}$ | $a_{12}$ | $a_{13}$ | $a_{22}$ | $a_{23}$ | $a_{33}$ |
|---|---|---|---|---|---|
| 0.2 | 0.5 | 0.3 | 0.4 | 0.6 | 0.7 |

OBSERVATION SYMBOL PROBABILITY STATE1

| | | | | | | | | | |
|---|---|---|---|---|---|---|---|---|---|
| $b_{MEL}$ | 0.04 | 0.02 | 0.07 | ····· | 0.03 | 0.05 | 0.01 | ····· | 0.03(128 SYMBOLS) |
| $b_{deltaMEL}$ | 0.03 | 0.04 | 0.01 | ····· | 0.03 | 0.04 | 0.05 | ····· | 0.05(128 SYMBOLS) |
| $b_{deltaENERGY}$ | 0.02 | 0.01 | 0.05 | ····· | 0.03 | (32 SYMBOLS) | | | |
| $b_{ENERGY}$ | 0.04 | 0.02 | 0.01 | ····· | 0.01 | (32 SYMBOLS) | | | |
| $b_{VOICENESS}$ | 0.08 | 0.04 | 0.01 | ····· | 0.03 | (32 SYMBOLS) | | | |

OBSERVATION SYMBOL PROBABILITY STATE2

| | | | | | | | | | |
|---|---|---|---|---|---|---|---|---|---|
| $b_{MEL}$ | 0.04 | 0.02 | 0.07 | ····· | 0.03 | 0.05 | 0.01 | ····· | 0.03(128 SYMBOLS) |
| $b_{deltaMEL}$ | 0.03 | 0.04 | 0.01 | ····· | 0.03 | 0.04 | 0.05 | ····· | 0.05(128 SYMBOLS) |
| $b_{deltaENERGY}$ | 0.02 | 0.01 | 0.05 | ····· | 0.03 | (32 SYMBOLS) | | | |
| $b_{ENERGY}$ | 0.04 | 0.02 | 0.01 | ····· | 0.01 | (32 SYMBOLS) | | | |
| $b_{VOICENESS}$ | 0.08 | 0.04 | 0.01 | ····· | 0.03 | (32 SYMBOLS) | | | |

OBSERVATION SYMBOL PROBABILITY STATE3

| | | | | | | | | | |
|---|---|---|---|---|---|---|---|---|---|
| $b_{MEL}$ | 0.04 | 0.02 | 0.07 | ····· | 0.03 | 0.05 | 0.01 | ····· | 0.03(128 SYMBOLS) |
| $b_{deltaMEL}$ | 0.03 | 0.04 | 0.01 | ····· | 0.03 | 0.04 | 0.05 | ····· | 0.05(128 SYMBOLS) |
| $b_{deltaENERGY}$ | 0.02 | 0.01 | 0.05 | ····· | 0.03 | (32 SYMBOLS) | | | |
| $b_{ENERGY}$ | 0.04 | 0.02 | 0.01 | ····· | 0.01 | (32 SYMBOLS) | | | |
| $b_{VOICENESS}$ | 0.08 | 0.04 | 0.01 | ····· | 0.03 | (32 SYMBOLS) | | | |

STATE TRANSITION PROBABILITY $a_{ij}$

OBSERVATION SYMBOL SEQUENCE $X = \{x_1, x_2, \cdots, x_T\}$

OBSERVATION SYMBOL DISCRETE PROBABILITY $b_j(x_t)$

VOICE CONVERTER FOR ASSIMILATION BY FRAME SYNTHESIS WITH TEMPORAL ALIGNMENT

RELATED APPLICATIONS

This application is a divisional application of application Ser. No. 09/693,144, filed Oct. 20, 2000, now U.S. Pat. No. 6,836,761.

BACKGROUND OF THE INVENTION

1. Field of the Invention

The present invention relates to a voice converter for assimilating a user voice to be processed to a different target voice, a voice converting method, and a voice conversion dictionary generating method for generating a voice conversion dictionary corresponding to the target voice used for the voice conversion, and more particularly to a voice converter, a voice converting method, and a voice conversion dictionary generating method preferred to be used for a karaoke apparatus.

In addition, the present invention relates to a voice processing apparatus for associating in time series a target voice with an input voice for temporal alignment, and to a karaoke apparatus having the voice processing apparatus.

2. Related Background Art

There have been developed various kinds of voice converters which change frequency characteristics of an input voice before an output. For example, there are karaoke apparatuses that convert a pitch of a singing voice of a karaoke player so as to convert a male voice to a female voice or vice versa (for example, Japanese PCT Publication No. 8-508581).

In the conventional voice converters, however, the voice conversion is limited to a conversion in only a voice quality though a voice is converted (for example, a male voice to a female voice, a female voice to a male voice, etc.) and therefore they are not capable of converting a voice to another in imitation of a voice of a specific singer (for example, a professional singer).

Furthermore, a karaoke apparatus would be very entertaining if it had something like an imitative function of assimilating not only a voice quality but also a way of singing to that of the professional singer. In the conventional voice converters, however, this kind of processing is impossible.

Accordingly, the inventors suggest a voice converter for a conversion in imitation of a voice of a singer to be targeted (a target singer) by analyzing the target singer's voice so as to assimilate a voice quality of the user to the target singer's voice, retaining achieved analysis data including a sinusoidal component attribute pitch, an amplitude, a spectrum shape, and residual components as target frame data for all frames of a music piece, and performing a conversion in synchronization with the input frame data obtained by analyzing the input voice (Refer to Japanese Patent Application No. 10-183338).

While the above voice converter is capable of assimilating not only a voice quality, but also a way of singing to that of the target singer, analysis data of the target singer is required for each music piece and therefore a data amount becomes enormously large when analysis data of a plurality of music pieces are stored.

Conventionally in a technical field of karaoke or the like, there has been provided a voice processing technology of converting a singing voice of a singer to another in imitation of a singing voice of a specific singer such as a professional singer. Generally this voice processing requires an execution of alignment for associating two voice signals with each other in time series. For example, in synthesizing a target singer's voice vocalized "nakinagara (with tears)" based on a singer's voice vocalized "nakinagara" in imitation of the target, the sound "ki" may be vocalized by the target singer at a different timing from that of the user singer.

In this manner, even if each person vocalizes the same sound, the duration is not identical and the sound may be non-linearly elongated or contracted in many cases. Therefore, in a comparison of two voices, there is known a DP matching method (dynamic time warping: DTW) for time normalization by elongating and contracting a time axis non-linearly so that the phonemes correspond to each other in the two voices. In the DP matching method, a typical time series is used as a standard pattern regarding a word or a phoneme, and therefore voices can be matched in units of a phoneme against a temporal structural change of a time-series pattern.

Additionally, there is known a technique using a hidden Markov model (HMM) having an excellent effect against a spectral fluctuation. In the hidden Markov model, a statistical fluctuation in the spectral time series can be reflected on a parameter of a model and therefore voices can be matched in units of a phoneme against a spectral fluctuation caused by individual variations of speakers.

However, the use of the above DP matching method deteriorates a precision for a spectral fluctuation and the conventional use of a hidden Markov model requires a large amount of a storage capacity and computation, and therefore both of them are unsuitable for voice process requiring real-time characteristics such as imitation in a karaoke apparatus.

SUMMARY OF THE INVENTION

Therefore, it is an object of the present invention to provide a voice converter capable of assimilating an input singer's voice to a target voice in a way of singing of a target singer and capable of reducing an analysis data amount of the target singer, voice converting method, and a voice conversion dictionary generating method.

It is another object of the present invention to provide a voice processing apparatus capable of executing real-time processing with a small storage capacity for voice processing of associating in time series a target voice with an input voice for temporal alignment, and a karaoke apparatus having the voice processing apparatus.

In one aspect of the invention, a voice converting apparatus is constructed for converting an input voice into an output voice according to a target voice. The apparatus comprises a storage section that provisionally stores source data, which is associated to and extracted from the target voice, an analyzing section that analyzes the input voice to extract therefrom a series of input data frames representing the input voice, a producing section that produces a series of target data frames representing the target voice based on the source data, while aligning the target data frames with the input data frames to secure synchronization between the target data frames and the input data frames, and a synthesizing section that synthesizes the output voice according to the target data frames and the input data frames.

Preferably, the storage section stores the source data containing pitch trajectory information representing a trajectory of a pitch of a phrase constituted by the target voice, phonetic notation information representing a sequence of phonemes with duration thereof in correspondence with the phrase of the target voice, and spectrum shape information representing a spectrum shape of each phoneme of the target voice. Further, the storage section stores the source data containing amplitude trajectory information representing a trajectory of an amplitude-of the phrase constituted by the target voice.

Preferably, the producing section comprises a characteristic analyzer that extracts from the input voice a characteristic vector which is characteristic of the input voice, a memory that memorizes recognition phoneme data for use in recognition of phonemes contained in the input voice and target behavior data which is a part of the source data and which represents a behavior of the target voice, an alignment processor that determines a temporal relation between the input data frames and the target data frames according to the characteristic vector, the recognition phoneme data and the target behavior data so as to output alignment data corresponding to the determined temporal relation, and a target decoder that produces the target data frames according to the alignment data, the input data frames and the source data containing phoneme data representing phonemes of the target voice. Further, the producing section comprises a data converter that converts the target behavior data in response to parameter control data provided from an external into pitch trajectory information representing a trajectory of a pitch of the target voice, amplitude trajectory information representing a trajectory of an amplitude of the target voice, and phonetic notation information representing a sequence of phonemes with duration thereof in correspondence with the target voice, and that feeds the pitch trajectory information and the amplitude trajectory information to the target decoder and feeds the phonetic notation information to the alignment processor.

Preferably, the target decoder includes an interpolator that produces a target data frame by interpolating spectrum shapes representing phonemes of the target voice. The interpolator produces a target data frame of a particular phoneme at a desired particular pitch by interpolating a pair of spectrum shapes corresponding to the same phoneme as the particular phoneme but sampled at different pitches than the desired pitch. Further, the target decoder includes a state detector that detects whether the input voice is placed in a stable state at a certain phoneme or in a transition state from a preceding phoneme to a succeeding phoneme, such that the interpolator operates when the input voice is detected to be in the transition state for interpolating a spectrum shape of the preceding phoneme and another spectrum shape of the succeeding phoneme with each other.

Preferably, the interpolator utilizes a modifier function for the interpolation of a pair of spectrum shapes so as to modify the spectrum shape of the target data frame. In such a case, the target decoder includes a function generator that generates a modifier function utilized for linearly modifying the spectrum shape and another modifier function utilized for nonlinearly modifying the spectrum shape. Practically, the interpolator divides the pair of the spectrum shapes into a plurality of frequency bands and individually applies a plurality of modifier functions to respective ones of the divided frequency bands. Practically, the interpolator operates when the input voice is transited from a preceding phoneme to a succeeding phoneme for utilizing a modifier function specified by the preceding phoneme in the interpolation of a pair of phonemes of the target voice corresponding to the pair of the preceding and succeeding phonemes of the input voice. Preferably, the interpolator operates in real time for determining a modifier function to be utilized in the interpolation according to one of a pitch of the input voice, a pitch of the target voice, an amplitude of the input voice, an amplitude of the target voice, a spectrum shape of the input voice and a spectrum shape of the target voice. Practically, the interpolator divides the pair of the spectrum shapes into a plurality of bands along a frequency axis such that each band contains a pair of fragments taken from the pair of the spectrum shapes, the fragment being a sequence of dots each determined by a set of a frequency and a magnitude, and the interpolator utilizes a modifier function of a linear type for the interpolation of the pair of the fragments a dot by dot in each band. In such a case, the interpolator comprises a frequency interpolator that utilizes the modifier function for interpolating a pair of frequencies contained in a pair of dots corresponding to each other between the pair of the fragments, and a magnitude interpolator that utilizes the modifier function for interpolating a pair of magnitudes contained in the pair of dots corresponding to each other.

Preferably, the target decoder produces the target data frames such that each target data frame contains a spectrum shape having an amplitude and a spectrum tilt, and the target decoder includes a tilt corrector that corrects the spectrum tilt in matching with the amplitude. In such a case, the tilt corrector has a plurality of filters selectively applied to the spectrum shape of the target data frame to correct the spectrum tilt thereof according to a difference between the spectrum tilt of the target data frame and a spectrum tilt of the corresponding input data frame.

The one aspect of the invention includes a method of producing a phoneme dictionary of a model voice of a model person for use in a voice conversion. The method comprises the steps of sampling the model voice as the model person continuously vocalizes a phoneme while the model person sweeps a pitch of the model voice through a measurable pitch range, analyzing the sampled model voice to extract therefrom a sequence of spectrum shapes along the measurable pitch range, dividing the measurable pitch range into a plurality of segments in correspondence to a plurality of pitch levels, statistically processing a set of spectrum shapes belonging to each segment to produce each averaged spectrum shape in correspondence to each pitch level, and recording the plurality of the averaged spectrum shapes and the plurality of the corresponding pitch levels to form the phoneme dictionary in which each phoneme sampled from the model person is represented by variable ones of the averaged spectrum shapes in terms of the pitch levels. Further, the step of statistically processing comprises dividing the set of the spectrum shapes into a plurality of frequency bands, then calculating an average of magnitudes of the spectrum shape at each frequency band, and collecting all of the calculated averages throughout all of the frequency bands to obtain the averaged spectrum shape.

In another aspect of the invention, a voice processing apparatus is constructed for aligning a sequence of phonemes of a target voice represented by a time-series of frames with a sequence of phonemes of an input voice represented by a time-series of frames. The apparatus comprises a target storage section that stores a sequence of phonemes contained in the target voice, the sequence of the phonemes being obtained by provisionally analyzing the time-series of the frames of the target voice, a phoneme storage section that stores a code book containing characteristic vectors representing characteristic parameters typical to phonemes, the characteristic vector being clustered into a number of symbols in the code book, and that stores a transition probability of a state of each phoneme and an observation probability of each symbol, a quantizing section that analyzes the time-series of the frames of the input voice to extract therefrom the characteristic parameters, and that quantizes the characteristic parameters into observed code vectors of the input voice according to the code book stored in the phoneme storage section, a state forming section that applies a hidden Markov model to the sequence of the phonemes of the target voice stored in the target storage section so as to estimate therefrom a time-series of states of the phonemes of the target voice based on the transition probability of the state of each phoneme and the observation probability of each symbol stored in the phoneme storage section, a transition determining section that determines transitions of states occurring in the sequence of the phonemes of the input voice by a Viterbi algorithm based on the observed symbols of the input voice and the estimated time-series of the states of the phonemes of the target voice, and an aligning section that aligns the sequence of the phonemes of the target voice and the sequence of the phonemes of the input voice with each other according to the determined state transitions of the input voice.

Preferably, the code book contains a characteristic vector which characterizes a spectrum of a voice in terms of a mel-cepstrum coefficient. The code book contains a characteristic vector which characterizes a spectrum of a voice in terms of a differential mel-cepstrum coefficient. The code book contains a characteristic vector which characterizes a voice in terms of a differential energy coefficient. The code book contains a characteristic vector which characterizes a voice in terms of an energy. The code book contains a characteristic vector which characterizes a voiceness of a voice in terms of a zero-cross rate and a pitch error observed in a waveform of the voice.

Preferably, the phoneme storage section stores the code book produced by quantization of predicted vectors of a given learning set using an algorithm for clustering. The phoneme storage section stores the transition probability of each state and the observation probability of each symbol with respect to the characteristic vector of each phoneme, the characteristic vector being obtained by estimating characteristic parameters maximizing a likelihood of a model for learning data.

Preferably, the transition determining section searches for an optimal state among a number of states around a current state of the estimated time-series of the states as to determine a transition from the current state to the optimal state occurring in the sequence of the phonemes of the input voice.

Preferably, the state forming section estimates the time-series of states of the phonemes of the target voice such that the time-series of states contains a pass from one state of one phoneme to another state of another phoneme and an alternative pass from one state to another state via a silent state or an aspiration state. Further, the state forming section estimates the time-series of states of the phonemes of the target voice such that the time-series of states contains parallel passes from one state of one phoneme to another state of another phoneme via different states of similar phonemes having equivalent transition probabilities.

Preferably, the aligning section aligns the sequence of the phonemes of the target voice and the sequence of the phonemes of the input voice with each other such that each phoneme has a region containing a variable number of frames and such that the number of frames contained in each region of each phoneme can be adjusted for the aligning of the target voice with the input voice. In such a case, the aligning section operates when a number of frames contained in a region of a phoneme of the input voice is greater than a number of frames contained in a corresponding region of the same phoneme of the target voice for adding a provisionally stored frame into the corresponding region, thereby expanding the corresponding region of the target voice in alignment with the region of the input voice. Further, the aligning section operates when a number of frames contained in a region of a phoneme of the input voice is smaller than a number of frames contained in a corresponding region of the same phoneme of the target voice for deleting one or more frame from the corresponding region, thereby compressing the corresponding region of the target voice in alignment with the region of the input voice.

Preferably, the transition determining section operates when determining a transition from a current state of a fricative phoneme for evaluating both of a transition probability to another state of another fricative phoneme and a transition probability to another state of a next phoneme of the target voice.

Preferably, the voice processing apparatus further comprises a synthesizing section that synthesizes the frames of the input voice and the frames of the target voice with each other synchronously by a frame to a frame after the input voice and the target voice are temporally aligned with each other. Further, the apparatus comprises an analyzing section that analyzes each frame of the input voice to extract therefrom sinusoidal components and residual components contained in each frame, wherein the target storage section stores the frames of the target voice such that each frame contains sinusoidal components and residual components provisionally extracted from the target voice, and wherein the synthesizing section mixes the sinusoidal components or the residual components of the input voice and the sinusoidal components or the residual components of the target voice with each other at a predetermined ratio at each frame. Further, the apparatus comprises a waveform generating section for applying an inverse Fourier transform to the mixed sinusoidal components and the residual components so as to generate a waveform of a synthesized voice.

Practically, the inventive apparatus further comprises a music storage section that stores music data representative of a karaoke music piece, a reproducing section that reproduces the karaoke music piece according to the stored music data, a synchronizing section that synchronizes the time-series of the frames of the target voice sampled from a model singer with a temporal progress of the karaoke music piece, a synthesizing section that synthesizes the frames of the input voice of a karaoke player and the frames of the target voice of the model singer with each other synchronously by a frame to a frame after the input voice and the target voice are temporally aligned with each other to form a time-series of an output voice, and a sounding section that sounds the output voice along with the karaoke music piece. In such a case, the transition determining section weighs the transition probability of each state of each phoneme in synchronization with the temporal progress of the karaoke music piece when the transition determining section determines transitions of states occurring in the sequence of the phonemes of the input voice.

BRIEF DESCRIPTION OF THE DRAWINGS

FIG. 12 is a diagram for explaining phonemes;

FIG. 13 is a diagram for explaining a phonemic dictionary;

DETAILED DESCRIPTION OF THE PREFERRED EMBODIMENTS

Preferred embodiments of the present invention will be described below by referring to the accompanying drawings.

[A] First Embodiment

A first embodiment of the present invention will be described, first.

[1] General Constitution of Voice Converter

Figure 1:
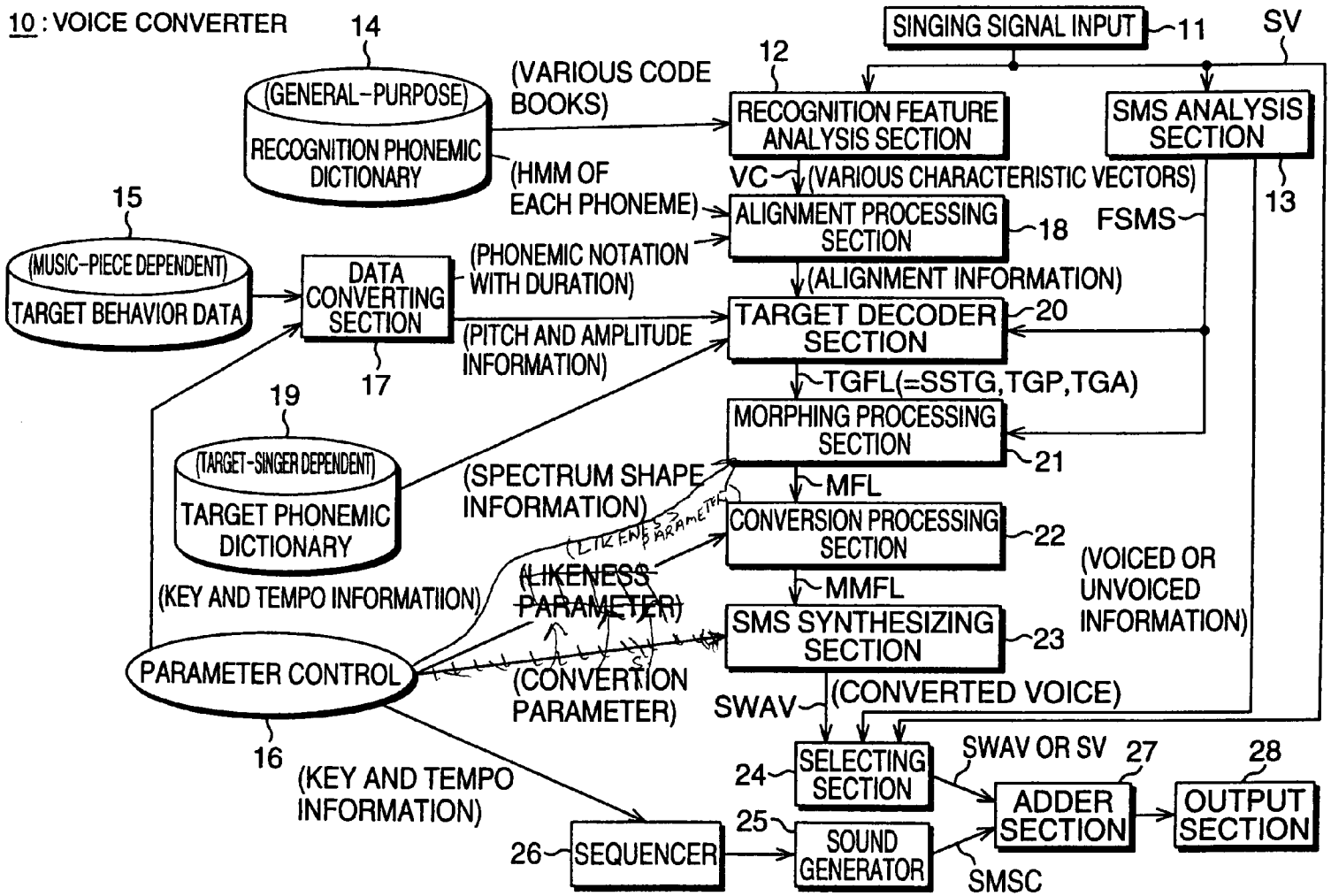
FIG. 1 is an outline constitutional block diagram of a voice converter according to an embodiment of the present invention.

Referring to FIG. 1, there is shown an example in which a voice converter (a voice converting method) of the embodiment is applied to a karaoke apparatus capable of performing imitation of a target singer.

The voice converter 10 comprises a singing signal input section 11 for inputting a singer's voice and for outputting a singing signal, a recognition feature analysis section 12 for extracting various characteristic vectors from the singing signal on the basis of a predetermined code book, an SMS analysis section 13 for executing an SMS (spectral modeling synthesis) analysis of the singing signal and generating input SMS frame data and voiced or unvoiced sound information, a recognition phonemic dictionary storing section 14 in which various code books and hidden Markov models (HMM) of respective phonemes are previously stored, a target behavior data storing section 15 for storing target behavior data dependent on a music piece, a parameter control section 16 for controlling various parameters such as key information, tempo information, a likeness parameter, and a conversion parameter, and a data converting section 17 for executing a data conversion on the basis of the target behavior data stored in the target behavior data storing section 19, the key information, and the tempo information and for generating and outputting converted phonemic notation information with duration, pitch information, and amplitude information.

The voice converter 10 further comprises an alignment processing section 18 for successively determining a part of the music piece that the karaoke singer is singing on the basis of the extracted characteristic vector, the HMM of each phoneme, and the phonemic notation information with duration by using a Viterbi algorithm and for outputting alignment information regarding a singing position and a phoneme in the music piece a target singer have to sing, a target phonemic dictionary storing section 19 for storing spectrum shape information dependent upon the target singer, a target decoder section 20 for generating and outputting target frame data TGFL on the basis of the alignment information, pitch information of target behavior data, amplitude information of target behavior data, input SMS frame data, and spectrum shape information of the target phonemic dictionary, a morphing processing section 21 for executing morphing process on the basis of the likeness parameter inputted from the parameter control section 16, the target frame data TGFL, and the SMS frame data FSMS and for outputting morphing frame data MFL, and a conversion processing section 22 for executing conversion processing on the basis of the morphing frame data MFL and the conversion parameter inputted from the parameter control section 16 and for outputting conversion frame data MMFL.

Still further, the voice converter 10 comprises an SMS synthesizing section 23 for executing an SMS synthesization of the conversion frame data MMFL and for outputting a waveform signal SWAV which is a conversion voice signal, a selecting section 24 for selectively outputting the waveform signal SWAV or the inputted singing signal SV on the basis of the voice/unvoice information, a sequencer 26 for driving a sound generator section 25 on the basis of the key information and the tempo information from the parameter control section 16, an adder section 27 for adding the waveform signal SWAV or the singing signal SV outputted from the selecting section 24 to a music signal SMSC which is an output signal from the sound generator section 25 and for outputting the mixed result, and an output section 28 for outputting the mixed signal from the adder section 27 as a karaoke signal after amplifying and other processing.

Before describing constitutions of respective components of the voice converter, the SMS analysis will be described below.

In the SMS analysis, there are segmented voice waveforms (frames) generated by multiplying sampled voice waveforms by window functions, and sinusoidal components and residual components are extracted from a frequency spectrum obtained by performing a fast Fourier transform (FFT).

In this condition, the sinusoidal component is a component of a frequency (overtone) equivalent to a fundamental frequency (pitch) or a multiple of the fundamental frequency.

In this embodiment, for the sinusoidal components, the fundamental frequency, an average amplitude of each component, and a spectrum envelope are retained.

The residual components are generated by excluding the sinusoidal components from an input signal, and the residual components are retained as frequency region data in this embodiment.

The obtained frequency analysis data represented by the sinusoidal components and the residual components is stored in units of a frame. At this point, a time interval between frames is fixed (for example, 5 ms) and therefore the time can be specified by counting frames. Furthermore, each frame has a time stamp appended thereto corresponding to an elapsed time from the beginning of a music piece.

[2] Constitution of Each Section of the Voice Converter

[2.1] Recognition Phonemic Dictionary Storing Section

The recognition phonemic dictionary storing section 14 stores code books and hidden Markov models of phonemes.

The stored code book is used for vector-quantizing the input singing signal to various characteristic vectors including mel-cepstrum, differential mel-cepstrum, energy, differential energy, and voiceness (voiced sound likelihood).

In addition, this voice converter uses a hidden Markov model (HMM) which is a voice recognition technique for alignment and stores HMM parameters (an initial state distribution, a state transition probability matrix, and an observation symbol probability matrix) obtained for respective phonemes (/a/, /i/, etc.).

[2.2] Target Behavior Data Storing Section

The target behavior data storing section 15 stores target behavior data. This target behavior data is music piece-dependent data corresponding to each music piece to be voice-converted.

Specifically, the data includes pitch and amplitude temporal changes extracted from a singing voice of a target singer which is a target of imitation of a target music piece and a phonemic notation with duration in which the words of a song are represented with phoneme sequences on the basis of the words of the song of the target music piece. For example, for phonemic notation /n//a//k//i/ - - - , each duration, namely, /n/ duration, /a/ duration, /k/ duration, and /i/ duration are included in the phonemic notation. By previously dividing the data into static response components and vibrato response components in the extraction, the degree of freedom for post-processing is increased.

[2.3] Target Phonemic Dictionary Storing Section

The target phonemic dictionary storing section 19 stores a target phonemic dictionary which is spectrum information corresponding to respective phonemes of the target singer to be imitated, and the target phonemic dictionary includes spectrum shapes corresponding to different pitches and anchor point information for use in executing a spectrum interpolation.

Figure 2:
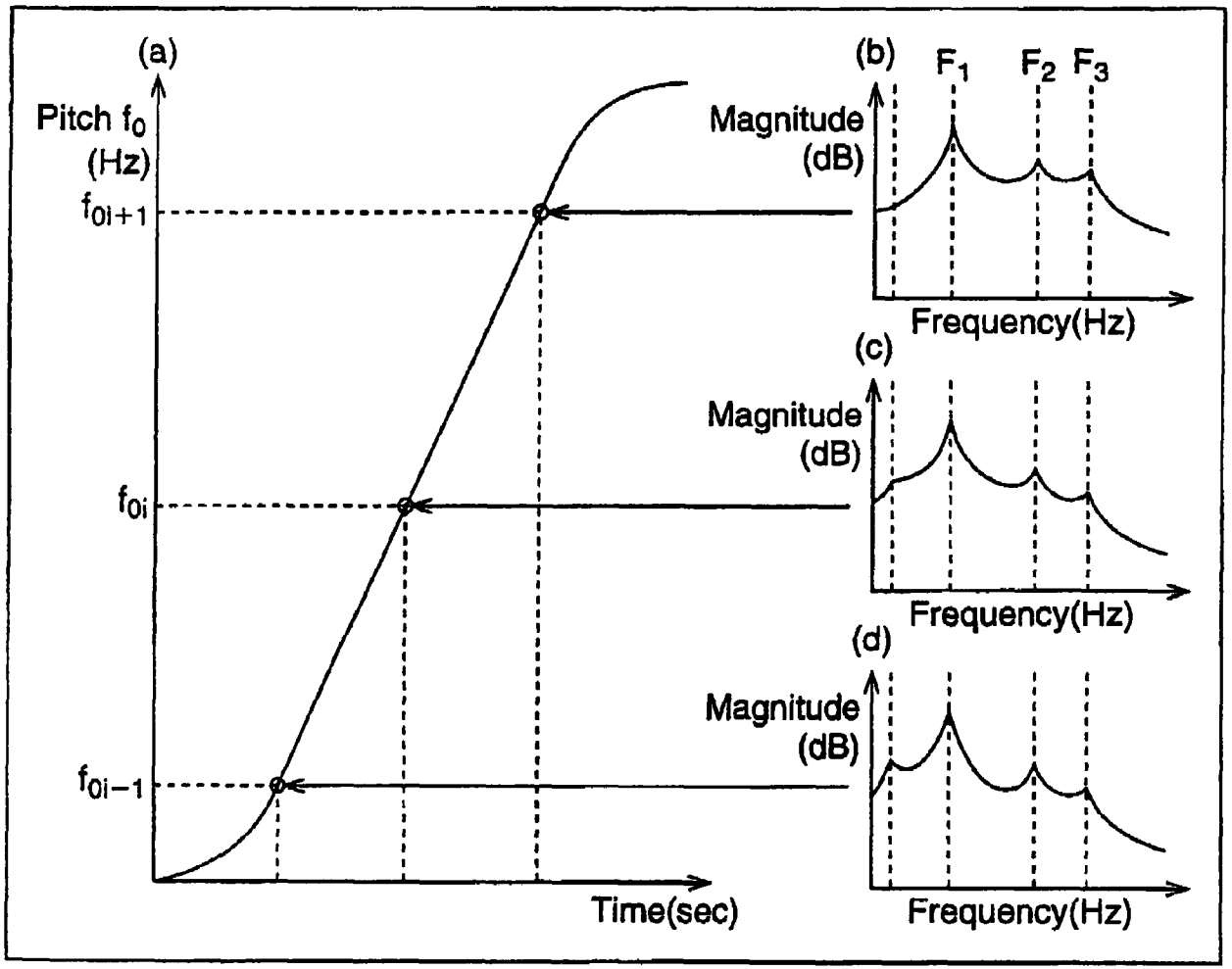
FIG. 2 is an explanatory diagram (1) of a target phonemic dictionary.
Figure 3:
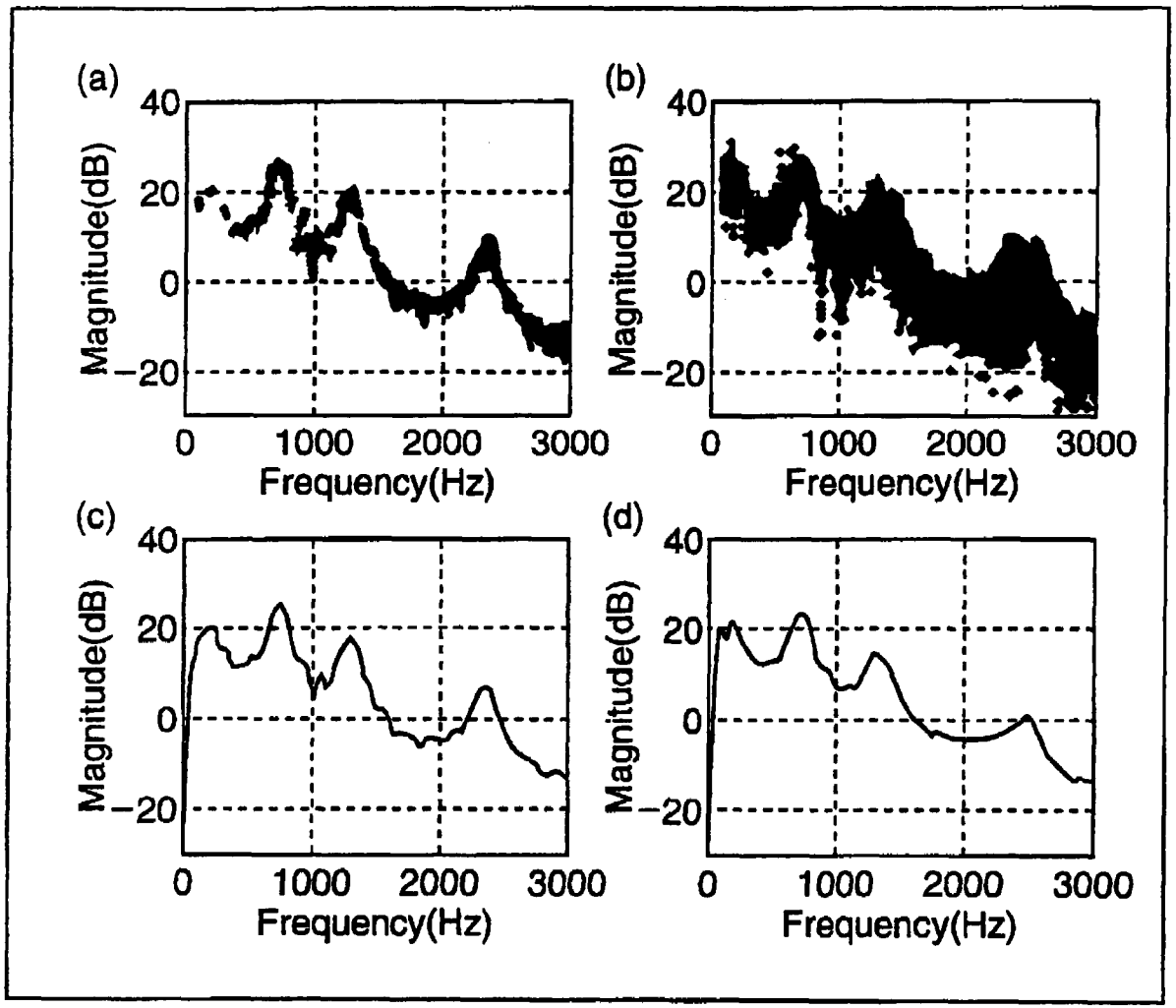
FIG. 3 is an explanatory diagram (2) of a target phonemic dictionary.

At this point, there is described a generation of a target phonemic dictionary as a voice conversion dictionary stored in the target phonemic dictionary storing section 19 by referring to FIGS. 2 and 3.

[2.3.1] Target Phonemic Dictionary

The target phonemic dictionary has spectrum shapes and anchor point information, corresponding to different pitches for each phoneme.

Referring to FIG. 2, there is shown an explanatory diagram of the target phonemic dictionary.

FIGS. 2(*b*), (*c*), and (*d*) show spectrum shapes corresponding to pitches f0*i*+1, f0*i*, and f0*i*−1 in a certain phoneme, respectively. A plurality of (three in the above examples) spectrum shapes are included per phoneme in the target phonemic dictionary. The reason why the target phonemic dictionary includes spectrum shapes corresponding to a plurality of pitches as described above is that spectrum shapes vary more or less according to pitches even if the same person vocalizes the same phoneme in general.

In FIGS. 2(*b*), (*c*), and (*d*), the dotted lines are boundaries for dividing the spectrum into a plurality of regions on the frequency axis, the frequency on the boundary of each region corresponds to an anchor point, and the frequency is included as anchor point information in the target phonemic dictionary.

[2.3.2] Target Phonemic Dictionary Generation

Next, a target phonemic dictionary generation will be described below.

First, continuous vocals of the target singer are sampled from the lowest pitch to the highest one for each phoneme. More specifically, as shown in FIG. 2(*a*), the pitch is increased with an elapse of time in the vocalization. The sampling is performed in this manner in order to calculate more accurate spectrum shapes. In other words, an actually existing formant will not always appear in a spectrum shape obtained by an analysis of a sample generated at a fixed pitch. Therefore, in order to cause a formant to appear accurately in a required spectrum shape, it is necessary to use all of the analysis result within a range considered the same spectrum shape around a certain pitch.

Supposing that a frequency range of a pitch considered the same spectrum shape is defined as a segment, a central frequency f0*i* of the ith segment is:

$$f_{0i} = f_i^{(low)} + \frac{f_i^{(high)} - f_i^{(low)}}{2} \quad \text{[Eq. 1]}$$

where, $f_i^{(low)}$ and $f_i^{(high)}$ are pitch frequencies at boundaries of the ith segment of a certain phoneme, $f_i^{(low)}$ designating a pitch frequency of a low pith side, and $f_i^{(high)}$ designating a pitch frequency of a high pitch side.

All the values of a spectrum shape at pitches belonging to the same segment (pairs of a frequency and a magnitude) are put together. More specifically as shown in FIG. 3(*a*), for example, spectrum shapes at pitches considered the same segment are plotted on an identical frequency axis and a magnitude axis. Next, the frequency range [0, $f_s$/2] is divided at regular intervals (for example, 30 [Hz]) on the frequency axis, where $f_s$ is a sampling frequency.

Supposing that a division width is BW [Hz] and the number of divisions is B (band number b∈[0, B−1]) and that a pair of the actual frequency and magnitude included in each division range is:

(xn, yn)

where n=0, - - - , N−1, a central frequency fb of the band b and an average magnitude Mb are calculated by the following equations, respectively:

$$M_b = \frac{1}{2N}\sum_{n=0}^{N-1}(y_{n+1} + y_n) \quad \text{[Eq. 2]}$$

$$f_b = \left(b + \frac{1}{2}\right)\cdot BW$$

The following pair of values obtained in this manner designates a spectrum shape at a final pitch:

(fb, Mb)

where b=0, - - - , B−1.

More specifically, if the spectrum shape is calculated by using the pair of the frequency and magnitude shown in FIG. 3(*a*), there is obtained a favorable spectrum shape having a clear formant which should be stored in the target phonemic dictionary as shown in FIG. 3(*c*).

On the contrary as shown in FIG. 3(*b*), if all the values (pairs of a frequency and a magnitude) of a spectrum shape at a pitch that cannot be considered the same segment are put together and the spectrum shape is calculated by using the collected pairs of the frequency and magnitude, there is obtained a spectrum shape having a relatively unclear formant as shown in FIG. 3(*d*) in comparison with the shape in FIG. 3(*c*).

[2.4] Target Decoder Section

[2.4.1]

Figure 4:
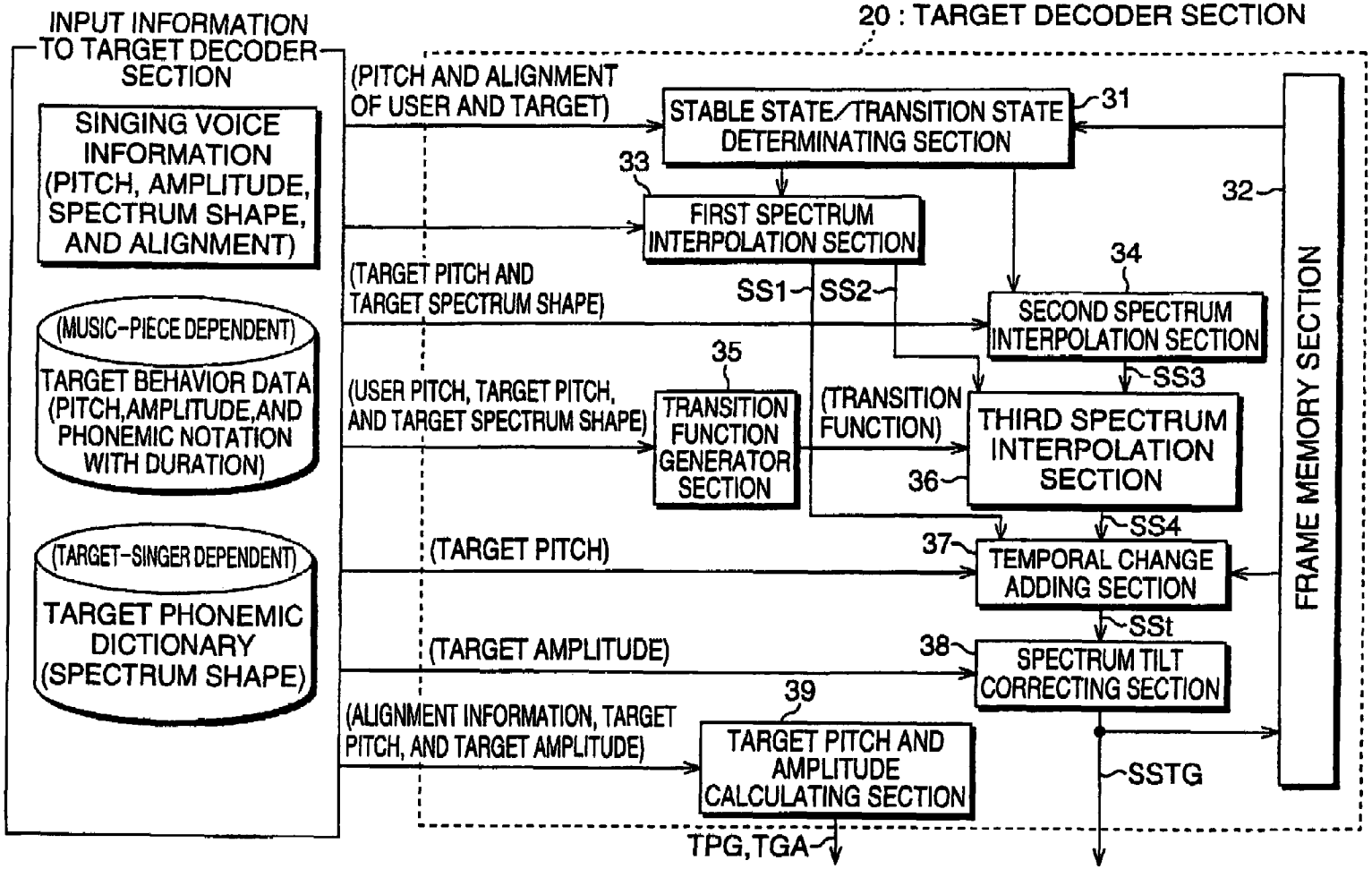
FIG. 4 is an outline constitutional block diagram of a target decoder section according to a first embodiment.

Referring to FIG. 4, there is shown a constitutional block diagram of the target decoder section 20. The target decoder section 20 comprises a stable state/transition state determination section 31 for determining whether a phoneme corresponding to a frame to be decoded is in a stable state or in a transition state to shift to another phoneme based on pitches of a user singer and a target singer, alignment information, and an already-processed decoded frame, a frame memory section 32 for storing the processed decoded frame to generate smooth frame data, and a first spectrum interpolation section 33 for generating a spectrum shape of the current phoneme as a first interpolation spectrum shape SS1 by using a spectrum interpolation method described later from two spectrum shapes in the vicinity of the current target pitch if the phoneme corresponding to the frame to be decoded is in a stable state on the basis of the determination result by the stable state/transition state determination section 31, or for generating a spectrum shape of a preceding phoneme of a transition as a second interpolation spectrum shape SS2 by using the spectrum interpolation method described later from two spectrum shapes in the vicinity of the current target pitch if the phoneme corresponding to the frame to be decoded is in a transition state.

The target decoder section 20 further comprises a second spectrum interpolation section 34 for generating a spectrum shape of a succeeding phoneme of the transition as a third interpolation spectrum shape SS3 by using the spectrum interpolation method described later from two spectrum shapes in the vicinity of the current target pitch if the phoneme corresponding to the frame to be decoded is in a transition state on the basis of the determination result by the stable state/transition state determination section 31, a transition function generator section 35 for generating a transition function for regulating the transition method in a transition from a preceding phoneme of the transition source to a succeeding phoneme of the transition destination taking into consideration the phoneme of the transition source, the phoneme of the transition destination, the user singer's pitch, the target singer's pitch, and spectrum shapes, and a third spectrum interpolation section 36 for generating a fourth spectrum shape SS4 by using the spectrum interpolation method described later from the transition function generated in the transition function generator section 35 and the two spectrum shapes (the second interpolation spectrum shape SS2 and the third interpolation spectrum shape SS3) if the phoneme corresponding to the frame to be decoded is in a transition state on the basis of the determination result by the stable state/transition state determination section 31.

The target decoder section 20 still further comprises a temporal change adding section 37 for changing a fine structure of the spectrum shape along the time axis on the basis of the target pitch and the processed decoded frame stored in the frame memory section 32 so as to obtain an output of a more realistic decoded frame (for example, changing the magnitude little by little with an elapse of time) and for outputting a temporal change added spectrum shape SSt, a spectrum tilt correcting section 38 for correcting a spectrum tilt of the spectrum shape SSt correspondingly to the amplitude of the target so as to make more realistic the spectrum shape SSt with the temporal change added in the temporal change adding section 37 and for outputting the corrected one as a target spectrum shape SSTG, and a target pitch and amplitude calculating section 39 for calculating a pitch and an amplitude of the target corresponding to the decoded frame outputted based upon the alignment information and the pitch and amplitude of the target.

[2.4.2] Detailed Operation of the Target Decoder Section

A detailed operation of the target decoder section 20 will be described below. In this condition, frame data to be outputted by the target decoder section 20 (decoded frame; target spectrum shape) is temporarily stored in the frame memory section 32 in order to generate smoother frame data.

Input information into the target decoder section 20 includes singing voice information (pitch, amplitude, spectrum shape, and alignment), target behavior data (pitch, amplitude, and phonemic notation with duration), and a target phonemic dictionary (spectrum shape).

The stable state/transition state determination section 31 determines whether or not a frame to be decoded is in a stable state (not in the middle of transition (change) from one phoneme to another phoneme, but in a state where a certain phoneme is specifiable) based on pitches of a karaoke singer and a target singer, alignment information, and a past decoded frame, and notifies the first spectrum interpolation section 33 and the second spectrum interpolation section 34 of the determination result.

If the frame to be decoded is determined to be in the stable state on the basis of the notification from the stable state/transition state determination section 31, the first spectrum interpolation section 33 calculates the spectrum shape of the current phoneme as a first interpolation spectrum shape SS1 which is a spectrum shape obtained by interpolation using the spectrum interpolation method described later from two spectrum shapes in the vicinity of the current target pitch, and outputs SS1 to the temporal change adding section 37.

In addition, if the frame to be decoded is determined to be in the transition state on the basis of the notification from the stable state/transition state determination section 31, the first spectrum interpolation section 33 calculates the spectrum shape of the preceding phoneme of the transition (the first phoneme in the transition from the first phoneme to the second phoneme) as a second interpolation spectrum shape SS2 which is a spectrum shape obtained by interpolation using the spectrum interpolation method described later from two spectrum shapes in the vicinity of the current target pitch, and outputs SS2 to the third spectrum interpolation section 36.

On the other hand, the second spectrum interpolation section 34, if the frame to be decoded is determined to be in the transition state on the basis of the notification from the stable state/transition state determination section 31, calculates the spectrum shape of the succeeding phoneme of the transition (the second phoneme in the transition from the first phoneme to the second phoneme) as a third interpolation spectrum shape which is a spectrum shape obtained by interpolation using the spectrum interpolation method described later from two spectrum shapes in the vicinity of the current target pitch, and outputs SS3 to the third spectrum interpolation section 36.

As a result of the above, the third spectrum interpolation section 36, if the frame to be decoded is determined to be in the transition state on the basis of the notification from the stable state/transition state determination section 31, calculates a fourth spectrum shape SS4 by interpolating with using the spectrum interpolation method described later on the basis of the second interpolation spectrum shape and the third interpolation spectrum shape calculated in the first and second spectrum interpolation processing, and outputs SS4 to the temporal change adding section 37.

The fourth spectrum shape SS4 is equivalent to a spectrum shape of an intermediate phoneme between two different phonemes. If the interpolation is performed to obtain the fourth spectrum shape SS4 in this condition, more realistic spectrum interpolation can be achieved not by simply performing linear interpolation in a corresponding region (its boundary points are indicated by anchor points) over a certain period of time, but by performing spectrum interpolation according to a non-linear transition function generated in the transition function generator section 35.

For example, the transition function generator section 35 changes a spectrum in the corresponding region (between anchor points described later) linearly in time in 10 frames for a change from phoneme /a/ to phoneme /e/ and changes the spectrum in 5 frames for a change from phoneme /a/ to phoneme /u/, while the function generator 35 changes a spectrum in a certain frequency band (between anchor points described later) linearly and changes a spectrum in another frequency band (between anchor points described later) with an exponential function, by which a natural shift between phonemes is smoothly achieved.

Therefore, in the transition function generating processing, a transition function is generated taking into consideration a singer's pitch, a target pitch, and a spectrum shape as well as being based on phonemes and pitches. In this condition, it is also possible that the above information is included in the target phonemic dictionary in the constitution as described later.

Next, the temporal change adding section 37 changes the fine structure of the spectrum shape for the inputted first interpolation spectrum shape SS1 or fourth interpolation spectrum shape SS4 on the basis of the target pitch and the past decoded frame so that the target spectrum shape outputted from the target decoder section 20 (decoded frame) is approximate to the existing frame, and outputs the result as a temporal change added spectrum shape SSt to the spectrum tilt correcting section 38. For example, a magnitude in the fine structure of the spectrum shape is changed little by little in time.

The spectrum tilt correcting section 38 corrects the inputted temporal change added spectrum shape SSt so as to impart a spectrum tilt corresponding to an amplitude of a target so that a target spectrum shape to be outputted (decoded frame) SSTG is more approximate to an existing frame, and outputs the corrected spectrum shape as a target spectrum shape SSTG.

As the spectrum tilt correcting processing, a shape of a higher zone of the spectrum shape is changed according to the volume of the voice in order to simulate the voice having richness of the higher zone in the spectrum shape for a great volume of the outputted voice and having poorness (unclear sound) of the higher zone in the spectrum shape for a small volume of the outputted voice in general. Then, the target spectrum shape SSTG obtained by correcting the spectrum tilt is stored in the frame memory section 32.

Figure 5:
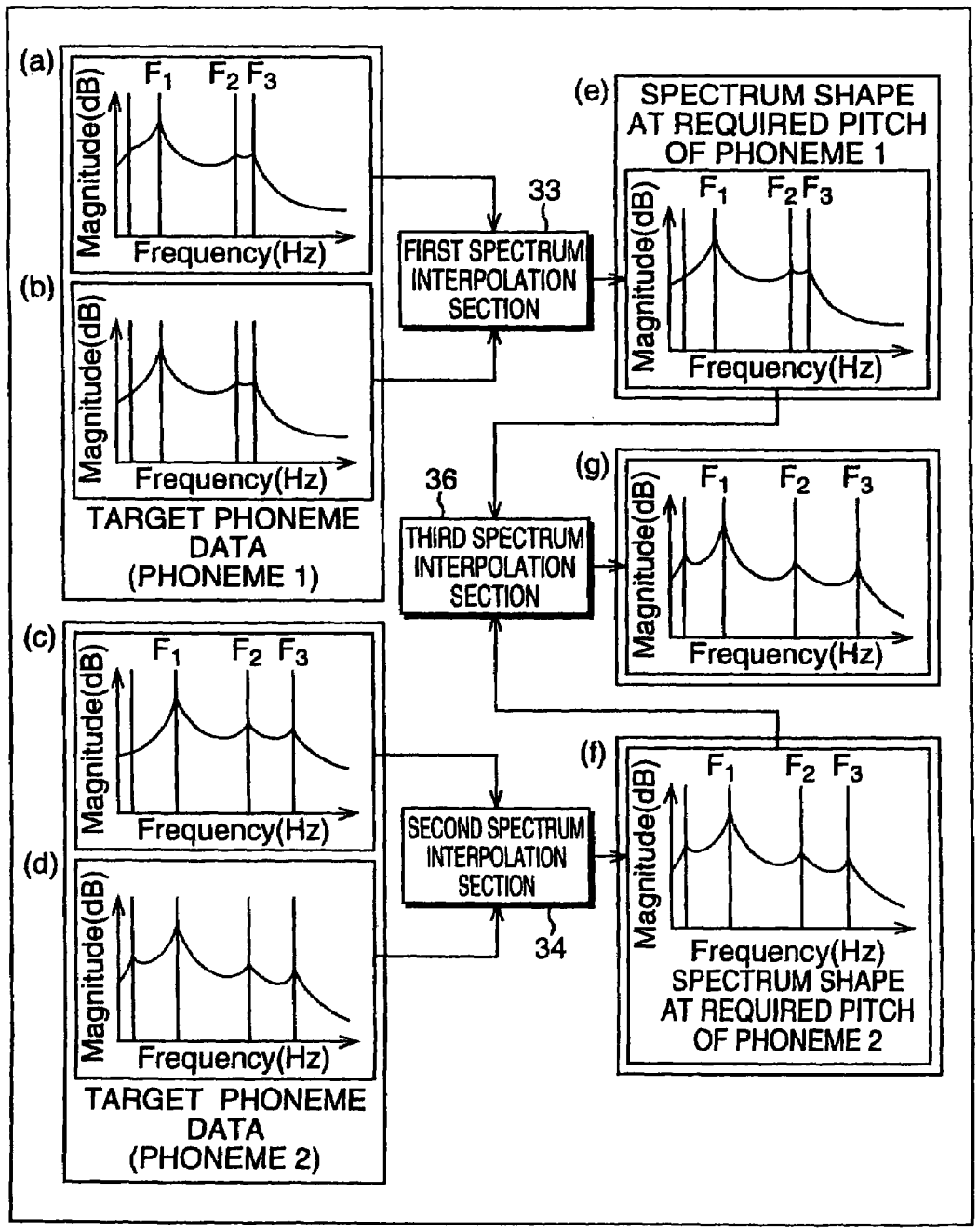
FIG. 5 is an explanatory diagram (1) of spectrum interpolation processing of the target decoder section.

On the other hand, the target pitch and amplitude calculating section 39 calculates and outputs a pitch TGP and an amplitude TGA corresponding to the outputted target spectrum shape SSTG. [2.4.3] Spectrum Interpolation Processing This section describes a spectrum interpolation processing of the target decoder section by referring to FIG. 5.

[2.4.3.1] Outline of Spectrum Interpolation Processing

First, if a phoneme corresponding to a frame to be decoded is found in a stable state based upon the determination result by the stable state/transition state determination section 31, the target decoder section 20 takes out two spectrum shapes corresponding to the phoneme from a target phonemic dictionary, and if the phoneme corresponding to the frame to be decoded is found in a transition state, the target decoder section 20 takes out two spectrum shapes corresponding to a first phoneme of a transition from the target phonemic dictionary.

Referring to FIGS. 5(*a*) and 5(*b*), there are shown two spectrum shapes taken out from the target phonemic dictionary correspondingly to the phoneme in the stable state or the first phoneme of the transition, and these two spectrum shapes have different pitches.

For example, supposing that a required spectrum shape has a pitch 140 [Hz] and belongs to phoneme /a/, the spectrum shape in FIG. 5(*a*) corresponds to phoneme /a/ of pitch 100 [Hz] and the other spectrum shape in FIG. 5(*b*) corresponds to phoneme /a/ of pitch 200 [Hz]. Namely, they are two spectrum shapes having higher and lower pitches closest to the required spectrum shape and corresponding to the same phoneme as for the required spectrum shape.

By applying interpolation to the obtained two spectrum shapes in a spectrum interpolation method by the first spectrum interpolating section 33, a desired spectrum shape (equivalent to the first spectrum shape SS1 or the second spectrum shape SS2) as shown in FIG. 5(*e*) is obtained. The obtained spectrum shape is directly outputted to the temporal change adding section 37 if the phoneme corresponding to the frame to be decoded is found in the stable state based upon the determination result by the stable state/transition state determination section 31.

Furthermore, if the phoneme corresponding to the frame to be decoded is found in the transition state based upon the determination result by the stable state/transition state determination section 31, two spectrum shapes corresponding to a second phoneme of the transition are taken out from the target phonemic dictionary. Referring to FIGS. 5(*c*) and 5(*d*), there are shown two spectrum shapes taken out from the target phonemic dictionary correspondingly to the second phoneme of the transition destination, and these two spectrum shapes have different pitches in the same manner as for FIGS. 5(*a*) and 5(*b*).

By applying interpolation to the obtained two spectrum shapes in the second spectrum interpolation section 34, a desired spectrum shape (equivalent to the third spectrum shape SS3) as shown in FIG. 5(*f*) is obtained.

Still further, if the phoneme corresponding to the frame to be decoded is found in the transition state based upon the determination result by the stable state/transition state determination section 31, spectrum shapes shown in FIGS. 5(*e*) and 5(*f*) are subjected to interpolation by the spectrum interpolation method in the third spectrum interpolation section 36, by which a desired spectrum shape (equivalent to the fourth spectrum shape SS4) as shown in FIG. 5(*g*) is obtained.

[2.4.3.2] Spectrum Interpolation Method

This section describes the spectrum interpolation method in detail.

Purposes for using the spectrum interpolation are generally classified into the following two groups:

(1) A spectrum shape of a frame between two frames in time is obtained by interpolation of spectrum shapes of two frames continuous in time.

(2) A spectrum shape of an intermediate sound is obtained by interpolation of spectrum shapes of two different sounds.

Figure 6A:
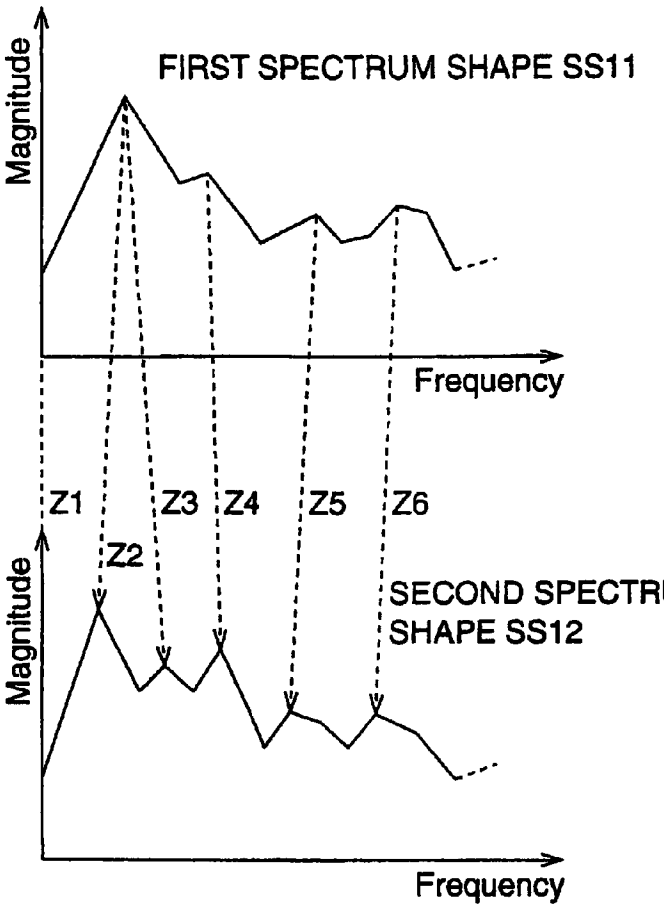
FIG. 6 is an explanatory diagram (2) of spectrum interpolation processing of the target decoder section.
Figure 6B:
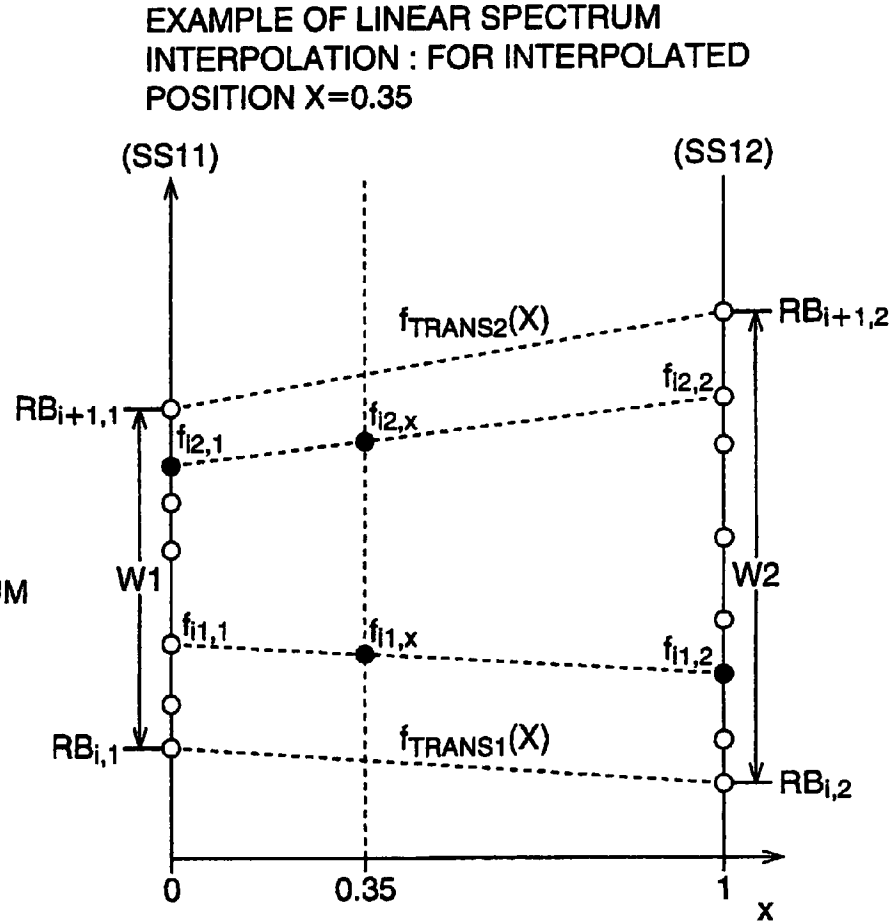

As shown in FIG. 6(*a*), two spectrum shapes subjected to the interpolation (hereinafter, referred to as a first spectrum shape SS11 and a second spectrum shape SS12 for the sake of convenience. Note that, however, these are quite different from the above first spectrum shape S1 and second spectrum shape S2.) are divided into a plurality of regions Z1, Z2, - - - along the frequency axis, respectively.

Then, the frequencies on the boundaries delimiting respective regions are preset for each spectrum shape as described below. The preset frequency on the boundary is referred to as an anchor point.

First spectrum shape SS11: RB1,1, RB2,1, - - - , RBN,1

Second spectrum shape SS12: RB1,2, RB2,2, - - - , RBM,2

Referring to FIG. 6(*b*), there is shown an explanatory diagram of linear spectrum interpolation.

The linear spectrum interpolation is defined according to an interpolated position, and the interpolated position X is within a range of 0 to 1. In this condition, the interpolated position X=0 is equivalent to the first spectrum shape SS11, and the interpolated position X=1 is equivalent to the second spectrum shape SS12.

FIG. 6(*b*) shows a condition in which the interpolated position X is 0.35. In FIG. 6(*b*), a mark "O" on the ordinate axis indicates each pair of a frequency and a magnitude composing a spectrum shape. Therefore, it is appropriate to consider that a magnitude axis exists in perpendicular to the direction of the drawing sheet.

It is supposed that anchor points corresponding to a certain region Zi in the first spectrum shape SS11 on the axis of the interpolated position X equal to 0 is:

RBi,1 and RBi+1,1 and that a frequency of one of the concrete pairs of a frequency and a magnitude belonging to the region Zi is fi1, and a magnitude of the pair is S1 (fi1).

It is supposed that anchor points corresponding to a certain region Zi in the second spectrum shape SS12 on the axis of the interpolated position X equal to 1 is:

RBi,2 and RBi+1,2 and that a frequency of one of the concrete pairs of a frequency and a magnitude belonging to the region Zi is fi2 and a magnitude of the pair is S2 (fi2).

In this condition, a spectrum transition function ƒtrans1(x) and a spectrum transition function ƒtrans2(x) are obtained.

For example, these are represented by the following most simple linear functions:

$$f\,\mathrm{trans1}(x)=m1\cdot x+b1$$

$$f\,\mathrm{trans2}(x)=m2\cdot x+b2$$

where $$m1=RBi,2-RBi,1$$

$$b1=\mathrm{RBi},1$$

$$m2=Rbi+1,2-RBi+1,1$$

$$b2=Rbi+1,2$$

Next, the process proceeds to find a frequency and a magnitude on the interpolation spectrum shape corresponding to a pair of a frequency and a magnitude existing on the first spectrum shape SS11. First, the process calculates as follows the pair of the frequency and the magnitude existing on the first spectrum shape SS11, specifically frequency fi1,2 and magnitude S2 (fi1,2) on the second spectrum shape corresponding to the frequency fi1 and the magnitude S1 (fi1):

$$f_{i1,2}=\frac{W_2}{W_1}(f_{i1}-RB_{i,1})+RB_{i,2} \qquad \text{[Eq. 3]}$$

where $$W1=RBi+1,1-RBi,1$$

$$W2=RBi+1,2-RBi,2$$

For calculating the magnitude S2(fi1,2), the frequencies closest to the frequency fi1,2 are expressed as follows with a suffix (+) or (−) so that the frequency fi1,2 is found between the closest frequencies, among the pairs of the frequency and the magnitude existing on the second spectrum shape SS12:

$$s_2(f_{i1,2})=s_2(f_{i1,2}^{(-)})+\left(\frac{s_2(f_{i1,2}^{(+)})-s_2(f_{i1,2}^{(-)})}{f_{i1,2}^{(+)}-f_{i1,2}^{(-)}}\right)\cdot(f_{i1,2}-f_{i1,2}^{(-)}) \qquad \text{[Eq. 4]}$$

Accordingly, supposing that the interpolated position is x, frequency fi1,x and magnitude Sx(fi1,x) on the interpolation spectrum shape corresponding to the pair of the frequency and the magnitude existing on the first spectrum shape SS11 are obtained by the following equation:

$$f_{i1,x}=\frac{(f_{trans2}(x)-f_{trans1}(x))}{W_1}(f_{i1}-RB_{i,1})+f_{trans1}(x) \qquad \text{[Eq. 5]}$$

$$Sx(fi1,x)=S1(fi1)+\{S2(fi1,2)-S1(fi1)\}\cdot x$$

In the same manner, the calculation is made for all the pairs of the frequency and the magnitude on the first spectrum shape SS11.

Subsequently the values are obtained for a pair of a frequency and a magnitude on the interpolation spectrum shape corresponding to a pair of a frequency and a magnitude existing on the second spectrum shape SS12.

First, the following calculation is made for the pair of the frequency and the magnitude existing on the second spectrum shape SS12, specifically frequency fi2,1 and magnitude S1 (fi2,1) on the first spectrum shape corresponding to the frequency fi2 and the magnitude S2 (fi2):

$$f_{i2,1}=\frac{W_1}{W_2}(f_{i2}-RB_{i,2})+RB_{i,1} \qquad \text{[Eq. 6]}$$

where $$W1=RBi+1,1-RBi,1$$

$$W2=RBi+1,2-RBi,2$$

For calculating the magnitude S1(fi2,1), the frequencies closest to the frequency fi2,1 are expressed as follows with a suffix (+) or (−) so that the frequency fi2,1 is found between the closest frequencies, among the pairs of the frequency and the magnitude existing on the first spectrum shape SS11:

$$s_1(f_{i2,1})=s_1(f_{i2,1}^{(-)})+\left(\frac{s_1(f_{i2,1}^{(+)})-s_1(f_{i2,1}^{(-)})}{f_{i2,1}^{(+)}-f_{i2,1}^{(-)}}\right)\cdot(f_{i2,1}-f_{i2,1}^{(-)}) \qquad \text{[Eq. 7]}$$

Accordingly, supposing that the interpolated position is x, frequency fi2,x and magnitude Sx(fi2,x) on the interpolation spectrum shape corresponding to the pair of the frequency and the magnitude existing on the second spectrum shape SS12 are obtained by the following equation:

$$f_{i2,x} = \frac{(f_{trans2}(x) - f_{trans1}(x))}{W_2}(f_{i2} - RB_{i,2}) + f_{trans1}(x) \quad \text{[Eq. 8]}$$

$$Sx(fi2, x) = S2(fi2) + \{S2(fi1, 2) - S1(fi2)\} \cdot (x - 1)$$

In the same manner, the values are calculated for all the pairs of the frequency and the magnitude on the second spectrum shape SS12.

As set forth in the above, an interpolated spectrum shape is obtained by rearranging all the calculation results of frequency fi1,x and the magnitude Sx(fi1,x)on the interpolation spectrum shape corresponding to the pair of the frequency fi1 and the magnitude S1(fi1) existing on the first spectrum shape SS11, frequency fi2,x and the magnitude Sx(fi2,x)on the interpolation spectrum shape corresponding to the pair of the frequency fi2 and the magnitude S2(fi2) existing on the second spectrum shape in an order of frequencies.

This processing is performed for all the regions Z1, Z2, and so on to calculate interpolation spectrum shapes in all the frequency bands.

While the spectrum transition functions f trans1(x) and f trans2(x) are assumed to be linear functions in the above example, they can be defined as nonlinear functions such as quadratic functions or exponential functions or may be constructed so that changes corresponding to the functions are prepared as a table.

In addition, more realistic spectrum interpolation can be achieved by changing these transition functions according to anchor points. In this case, the content of the target phonemic dictionary may be constructed so as to include transition function information attached to the anchor points.

Furthermore, the transition function information may be set according to a phoneme of the transition destination. Namely, if the phoneme of the transition destination is phoneme B, transition function Y is used, and if the phoneme of the transition destination is phoneme C, transition function Z is used for the setting so as to incorporate the setting state into the phonemic dictionary. Still further, an optimum transition function can be set in real time, taking into consideration a karaoke singer's pitch, a target singer's pitch, and spectrum shapes.

[3] General Operation

Next, a general operation of the voice converter 10 will be described below in order. At first, signal input processing is performed by the singing signal input section 11 to input a voice signal generated by a karaoke singer.

Subsequently the recognition feature analysis section 12 performs a recognition feature analysis processing, and executes vector quantization based upon a code book included in the recognition phonemic dictionary in order to feed a singing signal SV inputted via the singing signal input section 11 to the subsequent alignment processing section 18, and calculates respective characteristic vectors VC (mel-cepstrum, differential mel-cepstrum, energy, differential energy, voiceness (voiced sound likelihood), etc.).

The differential mel-cepstrum means a differential value of mel-cepstrum between the previous frame and the current frame. The differential energy is a differential value of signal energy between the previous frame and the current frame. The voiceness is a value synthetically calculated based upon a zero-cross rate a or detection error obtained at a pitch detection, or a value obtained with being synthetically weighted, and is a numeric value representative of a likeness of a voiced sound.

On the other hand, the SMS analysis section 13 SMS-analyzes the singing signal SV inputted via the singing signal input section 11 to obtain SMS frame data FSMS, and outputs FSMS to the target decoder section 20 and to the morphing processing section 21. Specifically, the following processing is executed for a waveform segmented by a window width according to a pitch:

(1) Fast Fourier transform (FFT) processing
(2) Peak detection processing
(3) Voiced/unvoiced judgement processing and pitch detection processing
(4) Peak continuing processing
(5) Calculation processing for sinusoidal component attribute pitch, amplitude, spectrum shape
(6) Calculation processing for residual components The alignment processing section 18 sequentially finds respective parts of the music piece sung by the karaoke singer using Viterbi algorithm on the basis of various characteristic vectors VC outputted from the recognition feature analysis section 12, HMM of respective phonemes from the recognition phonemic dictionary 14, and the phonemic notation information with duration included in the target behavior data.

By this operation the alignment information is obtained, thereby allocating a pitch, an amplitude, and a phoneme of the target generated by the target singer.

In this processing, if the karaoke singer voices a certain phoneme relatively longer than that of the target singer, it is judged that he or she generates the phoneme exceeding the duration of the phonemic notation information with duration, which results in supplementing information of entering loop processing to the alignment information to be output.

As a result, the target decoder section 20 calculates the target spectrum shape SSTG, the pitch TGP, and the amplitude TGA as frame information (a pitch, an amplitude, and a spectrum shape.) of the target singer on the basis of the alignment information outputted from the alignment processing section 18 and the spectrum information included in the target phonemic dictionary 19, and outputs them as target frame data TGFL to the morphing processing section 21.

The morphing processing section 21 performs morphing process on the basis of the target frame data TGFL outputted form the target decoder section 20, the SMS frame data FSMS corresponding to the singing signal SV, and the likeness parameter inputted from the parameter control section 16, then generates morphing frame data MFL having the desired spectrum shape, pitch, and amplitude according to the likeness parameter, and outputs MFL to the conversion processing section 22.

The conversion processing section 22 transforms the morphing frame data MFL according to the conversion parameter from the parameter control section 16, and outputs the result as conversion frame data MMF to the SMS synthesizing section 23. In this case, more realistic output voices can be obtained by a spectrum tilt correction according to an output amplitude. In addition, there may be performed even-number overtone eliminating processing or the like, in the conversion processing section 22.

The SMS synthesizing section 23 converts the conversion frame data MMFL to frame spectrum, then performs inverse fast Fourier transform (IFFT), overlap processing, and addition processing, and outputs the results as a waveform signal SWAV to a selecting section 24.

The selecting section 24 outputs the singing signal SV directly to the adder section 27 if the voice of the singer corresponding to the singing signal SV is a voiceless or unvoiced sound on the basis of the voiced/voiceless information from the SMS analysis section 13, and outputs the waveform signal SWAV to the adder section 27 if the voice of the singer corresponding to the singing signal SV is a voiced sound.

In parallel with these operations, the sequencer 26 drives the sound generator 25 under the control of the parameter control section 16, generates a music signal SMSC, and outputs SMSC to the adder section 27. The adder section 27 mixes the waveform signal SWAV or the singing signal SV outputted from the selecting section 24 with the music signal SMSC outputted from the sound generator 25 at an appropriate ratio, adds them together, and outputs the result to the output section 28. The output section 28 outputs a karaoke signal (voice plus music) on the basis of the output signal from the adder section 27.

[B] Second Embodiment

Next, a second embodiment of the present invention will be described below. The second embodiment of the present invention differs from the first embodiment in that a spectrum shape outputted to the morphing processing section is calculated based upon a karaoke singer's pitch and spectrum tilt information in the second embodiment, though the spectrum shape is calculated based upon a target pitch and amplitude included in the target behavior data in the target decoder section of the first embodiment.

While it is required to calculate also a spectrum tilt as a sinusoidal component attribute in the SMS analysis section of the second embodiment due to the above, a constitution of respective sections is the same as for the first embodiment except a target decoder section.

[1] Target Decoder Section

Figure 7:
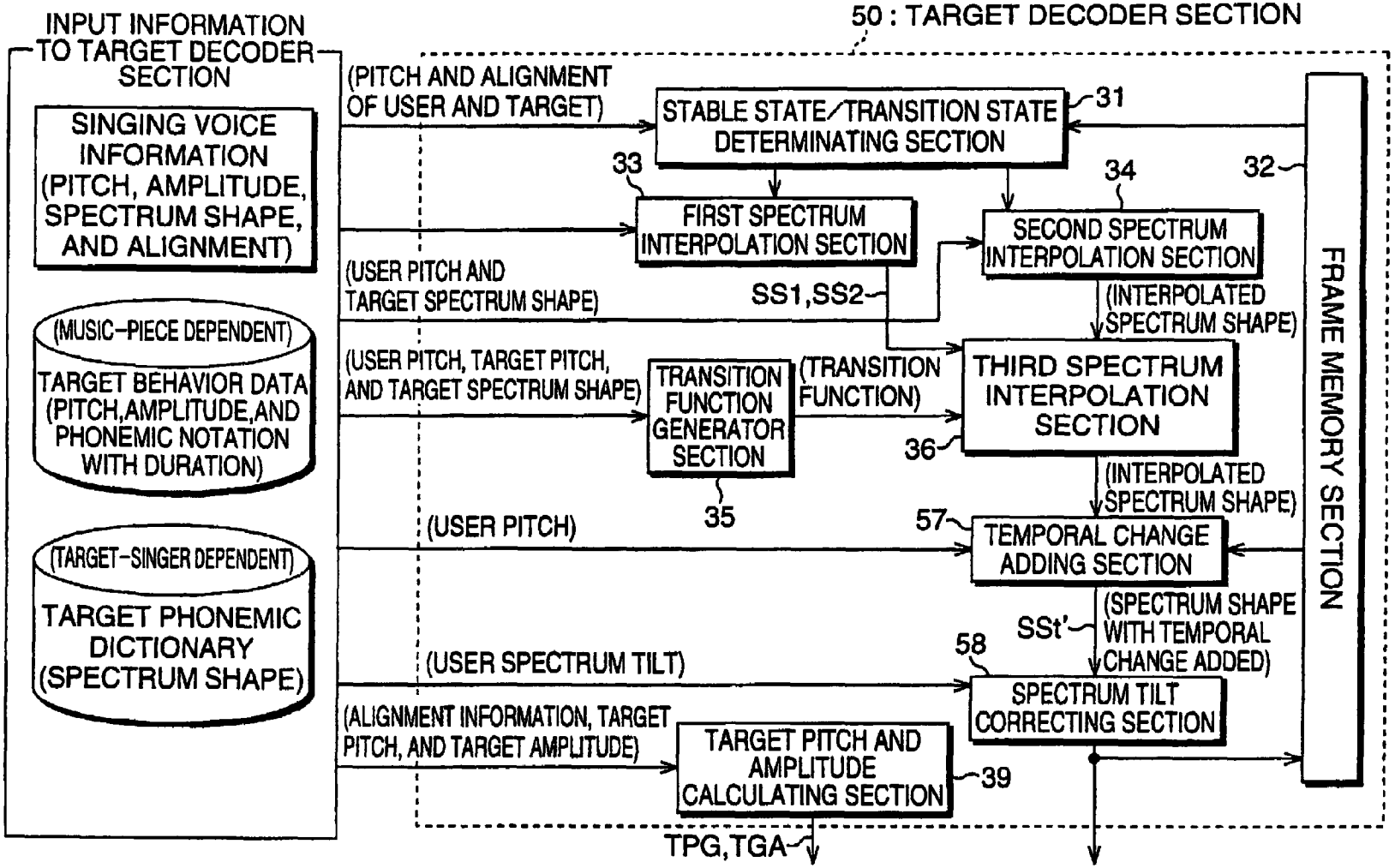
FIG. 7 is an outline constitutional block diagram of a target decoder section according to a second embodiment.

Referring to FIG. 7, there is shown a constitutional block diagram of the target decoder section of the second embodiment. In FIG. 7, identical reference numerals are appended to the same portions as for the first embodiment shown in FIG. 4, and their detailed description will be omitted here.

The target decoder section 50 comprises a stable state/transition state determination section 31, a frame memory section 32, a first spectrum interpolation section 33, a second spectrum interpolation section 34, a transition function generator section 35, a third spectrum interpolation section 36, a temporal change adding section 57 for changing a fine structure of a spectrum shape along a time axis (for example, changing a magnitude with an elapse of time little by little) based upon a karaoke singer's pitch and a processed decoded frame stored in the frame memory section 32 so as to make a decoded frame to be more realistic, a spectrum tilt correcting section 58 for comparing a spectrum tilt of the karaoke singer with a tilt of an already generated spectrum shape in order to make the spectrum shape to which a temporal change is added by the temporal change adding section 57 more realistic, for correcting the spectrum tilt of the spectrum shape and for outputting the corrected spectrum shape as a target spectrum shape SSTG, and for storing the target spectrum shape SSTG to the frame memory section 32, and a target pitch and amplitude calculating section 39.

[2] Operation of Second Embodiment

Operations of the second embodiment are the same as for the first embodiment in general, and therefore this section describes only operations of a distinct portion.

The temporal change adding section 57 of the target decoder section 50 changes a fine structure of a spectrum shape (a first spectrum shape SS1 or a fourth spectrum shape SS4) along a time axis (for example, changing a magnitude with an elapse of time little by little) based upon the karaoke singer's pitch and the processed decoded frame stored in the frame memory section 32 and outputs the processed result to the spectrum tilt correcting section 58.

The spectrum tilt correcting section 58 compares the spectrum tilt of the karaoke singer with the tilt of the already generated target spectrum shape in order to make the target spectrum shape SSTG outputted from the target decoder section 50 more realistic, then corrects the spectrum tilt of the spectrum shape and outputs the corrected spectrum shape as a target spectrum shape SSTG, and stores the target spectrum shape SSTG to the frame memory section 32.

Figure 8:
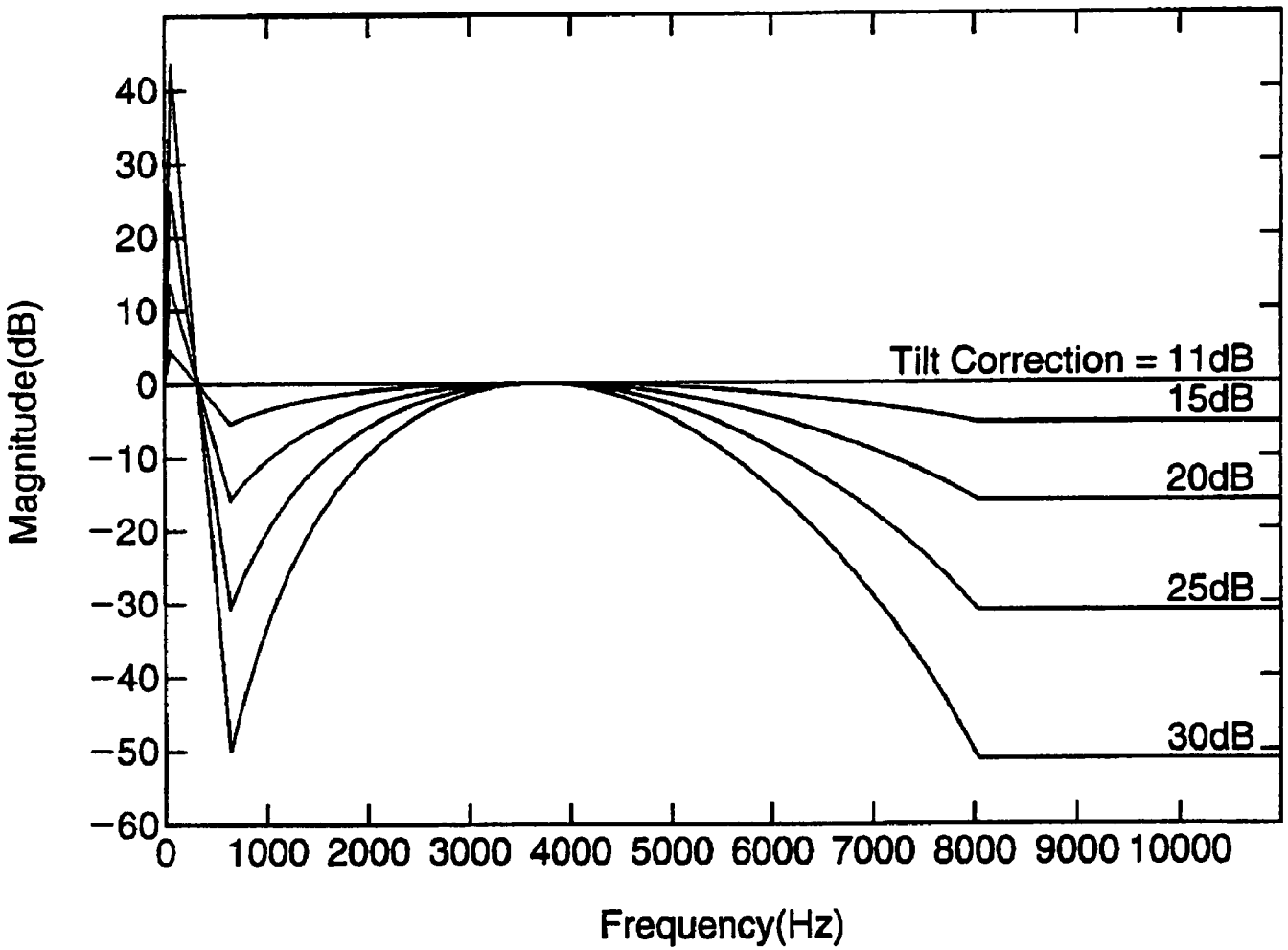
FIG. 8 is an explanatory diagram of characteristics of a spectrum tilt correction filter according to the second embodiment.

More specifically, the spectrum tilt correcting section calculates a spectrum tilt correction value which is a difference between the spectrum tilt of the karaoke singer and the spectrum tilt of the generated target spectrum shape, and filters the generated target spectrum shape with a spectrum tilt correction filter having a characteristic according to the spectrum tilt correction vale as shown in FIG. 8. As a result, a more natural spectrum shape is obtained.

[C] Alteration of the Embodiment

[1] First Alteration

If a pitch and an amplitude are retained as information previously classified into a static change component and a vibratory change component (vibrato is treated as speed and depth parameters), a pitch and an amplitude can be generated with appropriate vibrato added even if the singer vocalizes the same phoneme longer than the target, by which a natural vocal elongation can be obtained.

The reason why this processing is performed is that an omission of this processing might cause such a phenomenon that vibrato is not effected in the middle of a sound generated by the karaoke singer when the singer elongates the voice longer in comparison with the target singer, thereby making the sound unnatural, or might cause the vibrato to be more rapid at an increase of the tempo if there is no vibrato component when the karaoke singer changes the tempo in comparison with the target singer, thereby making the voice unnatural, too.

[2] Second Alteration

While residual components of the target singer have not been taken into consideration in the above description, retaining residual components for all frames is not applicable to this voice converter from the viewpoint of information compression when taking into consideration of the residual components of the target singer. Therefore, it is preferable to prepare typical spectrum envelopes in advance regarding residuals and to prepare index information for specifying these spectrum envelopes.

More specifically, a residual spectrum envelope information index is prepared as target behavior data and, for example, a spectrum envelope with a residual spectrum envelope information index 1 is used within a range of 0 sec to 2 sec of the singing elapsed time, and another spectrum envelope with a residual spectrum envelope information index 3 is used within a range of 2 sec to 3 sec of the singing elapsed time. Then, an actual residual spectrum is generated from the spectrum envelope corresponding to the residual spectrum envelope information index, and the residual spectrum is used in morphing processing, by which morphing is enabled also for residuals.

Now, referring to appended drawings, another aspect of the present invention will be described below.

1. Constitution of Embodiment

[1-2. General Constitution]

Figure 9:
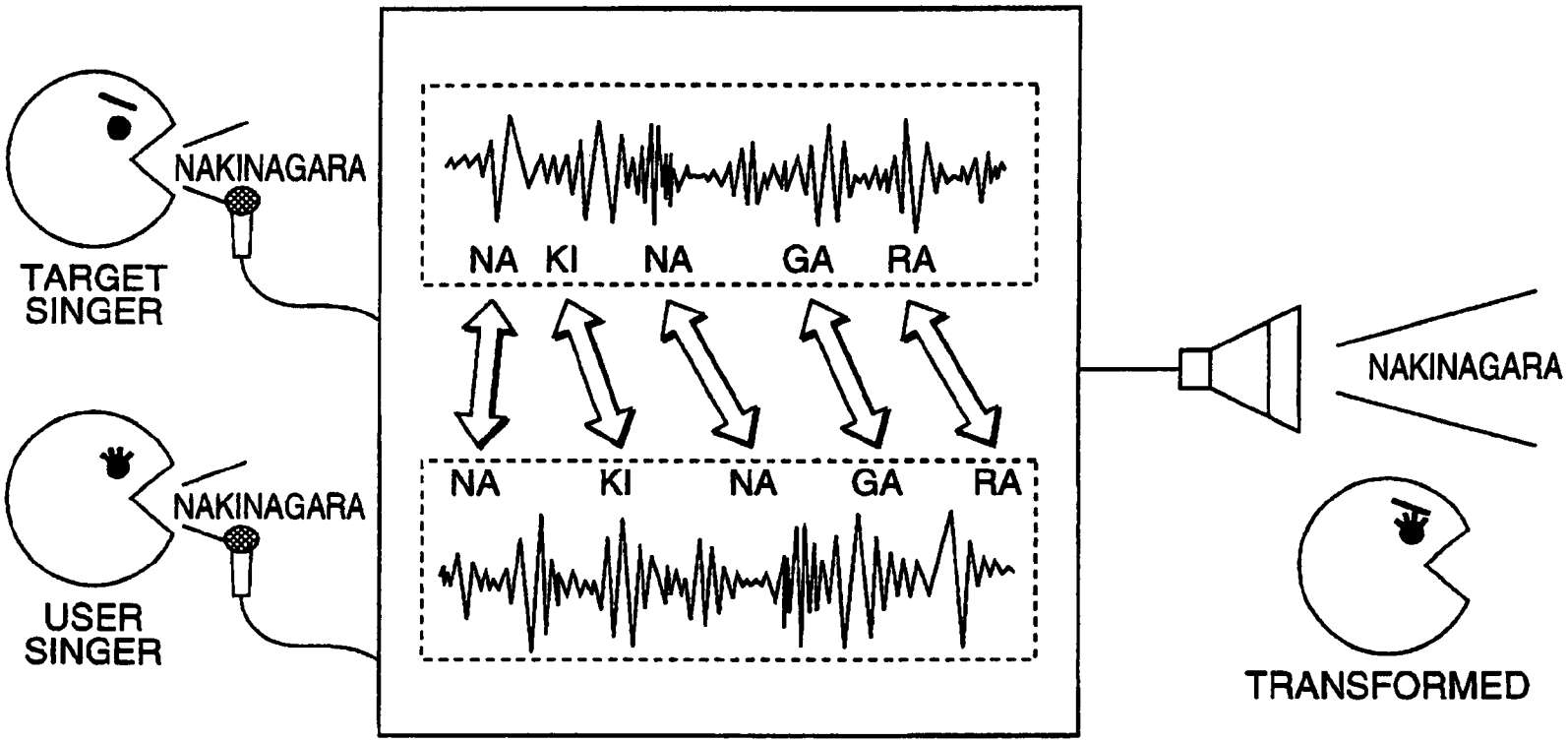
FIG. 9 is a diagram for explaining an outline of a voice processing apparatus according to the present invention.

Referring to FIG. 9, there is shown a typical diagram illustrating a concept of this invention. An input voice of a karaoke singer "nakinagara (with tears)" is converted based on a target voice "nakinagara" of a target singer to obtain an output voice "nakinagara." In this processing, temporal alignment is applied to each phoneme between the input voice and the target voice.

Figure 10:
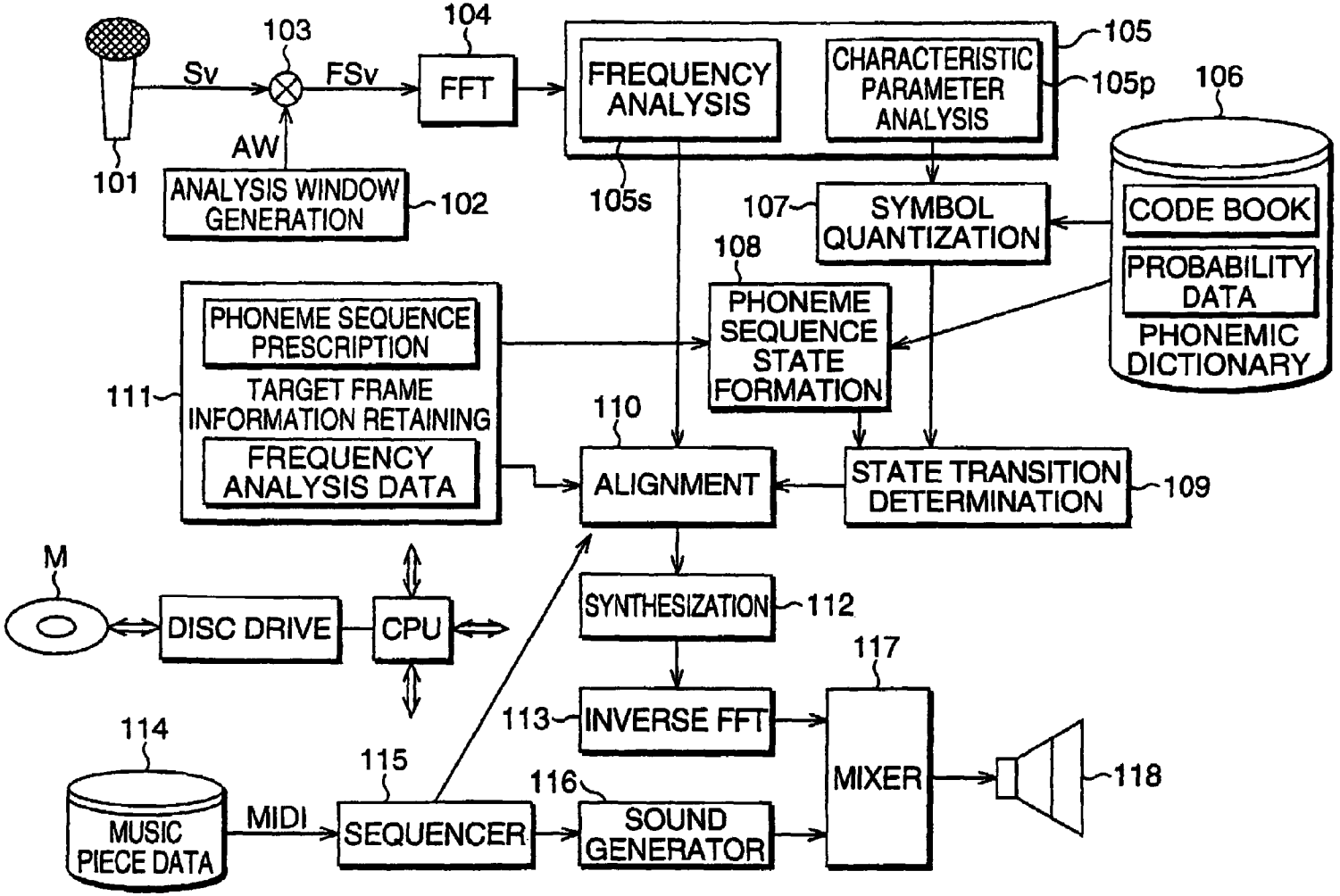
FIG. 10 is a block diagram of a constitution of an embodiment of the invention.

Referring to FIG. 10, there is shown a diagram of a constitution of this embodiment. In this embodiment, the present invention is applied to a karaoke apparatus with an imitative function, in which an input voice from a microphone 101 of a karaoke singer is converted to another voice assimilated to, for example, a professional singer before output.

More specifically, if it is possible to specify a frame of the target corresponding to a frame of the input voice by previously storing data of the target voice previously analyzed in units of a frame delimited in units of a predetermined time and by analyzing the input voice in units of a frame delimited in units of a predetermined time in the same manner, a coincident time relationship can be obtained. In this constitution, the input voice is converted by synthesizing frame data with the input voice matched to the target voice in units of a phoneme.

In FIG. 10, a microphone 101 collects voices of a karaoke singer attempting to imitate the target singer's voice and outputs the input voice signal Sv to the input voice signal segmenting section 103. An analysis window generating section 102 generates an analysis window (for example, a Hamming window) AW having a fixed period identical to a pitch period detected in the previous frame, and outputs the AW to the input voice signal segmenting section 103. If the initial frame or the previous frame is a voiceless sound (including silence), an analysis window of a preset fixed period is outputted as an analysis window AW to the input voice signal segmenting section 103.

The input voice signal segmenting section 103 multiplies the inputted analysis window AW by the input voice signal Sv, segments the input voice signal Sv in units of a frame, and outputs them as frame voice signals FSv to a fast Fourier transforming section 104. The fast Fourier transforming section 104 obtains a frequency spectrum from the frame voice signals FSv, and outputs the spectrum to an input voice analysis section 105 having a frequency analysis section 105*s* and a characteristic parameter analysis section 105*p*.

The frequency analysis section 105*s* extracts sinusoidal components and residual components by performing the SMS (spectral modeling synthesis) analysis and retains them as frequency component information of a karaoke singer of the analyzed frame.

The characteristic parameter analysis section 105*p* extracts characteristic parameters featuring spectrum characteristics of the input voice, and outputs them to a symbol quantization section 107. In this embodiment, there are used five types of characteristic vectors (a mel-cepstrum coefficient, a differential mel-cepstrum coefficient, a differential energy coefficient, energy, voiceness) described later as characteristic parameters.

A phonemic dictionary storing section 106, as described later in detail, stores a phonemic dictionary including code books and probability data indicating a state transition probability and an observation symbol probability of a characteristic vector in each phoneme.

The symbol quantization section 107 selects a characteristic symbol in a frame by referring to the code books stored in the phonemic dictionary storing section 106 and outputs the selected symbol to a state transition determination section 109.

A phoneme sequence state forming section 108 forms a phoneme sequence state using the hidden Markov model (HMM), and the state transition determination section 109 determines a state transition Viterbi algorithm described later using characteristic symbols among a frames obtained from the input voice.

An alignment section 110 determines a time pointer for the input voice based upon the determined state transition, specifies a target frame corresponding to the time pointer, and outputs frequency components of the input voice retained in the frequency analysis section and frequency components of the target retained in a target frame information retaining section 111 to a synthesizing section 112.

The target frame information retaining section 111 stores frequency analysis data of frequencies previously analyzed for each a frame and phoneme sequences prescribed in units of a time region composed of some frames.

The synthesizing section 112 generates new frequency components by synthesizing the frequency components of the input voice and the frequency components of the target at a predetermined ratio, and outputs the result to an inverse fast Fourier transforming section 113. The inverse fast Fourier transforming section 113 generates a new voice signal by the inverse fast Fourier transformation of the new frequency components.

In this embodiment, there is provided a karaoke apparatus having an imitative function, in which a music piece data storing section 114 stores karaoke music piece data including MIDI data, time data, lyric data, or the like. The apparatus further comprises a sequencer 115 for reproducing MIDI data according to time data, and a sound generator 116 for generating a musical sound signal from output data fed from the sequencer 115.

A mixer 117 synthesizes the musical sound signal outputted from the inverse fast Fourier transforming section 113 with the musical sound signal outputted from the sound generator 116, and outputs the result from a speaker 119.

In this manner, if a karaoke singer sings a song over the microphone 101, a new voice which is converted from a voice of the karaoke singer for imitation of a target singer's voice is outputted with accompaniment musical sounds of the karaoke music from the speaker 118.

The inventive apparatus shown in FIG. 10 may be implemented by a computer machine having a CPU for controlling every section of the inventive apparatus. In such a case, a machine readable medium M composed of a magnetic disc or optical disc may be loaded into a disc drive of the inventive apparatus having the CPU for temporally aligning a sequence of phonemes of a target voice represented by a time-series of frames with a sequence of phonemes of an input voice represented by a time-series of frames. The medium M contains program instructions executable by the CPU for causing the apparatus to perform a voice alignment process as described below in detail. Further, the machine readable medium M may be used in the apparatus having the CPU for converting the input voice into the output voice according to the target voice. In such a case, the medium M contains program instructions executable by the CPU for causing the inventive apparatus to perform the voice converting process as described before.

[1-2. Phonemic Dictionary]

Next, a phonemic dictionary used in this embodiment will be described below. The phonemic dictionary comprises code books having clusters of a fixed number of symbols with typical characteristic parameters of a voice signal as characteristic vectors, a state transition probability and an observation probability of the respective symbols, both of which are obtained for each phoneme.

[1-2-1. Characteristic Vector]

Previous to describing the code book, the characteristic vectors used in this embodiment are described first.

(1) Mel-Cepstrum Coefficient ($b_{MEL}$)

A mel-cepstrum coefficient indicates a spectrum characteristic of a voice by a small number of degrees or orders. In this embodiment, $b_{MEL}$ is clustered in 128 symbols as a 12-dimensional vector.

(2) Differential Mel-Cepstrum Coefficient ($b_{deltaMEL}$)

A differential mel-cepstrum coefficient indicates a time difference of the mel-cepstrum coefficient. In this embodiment, it is clustered in 128 symbols as a 12-dimensional vector.

(3) Differential Energy Coefficient ($b_{deltaENERGY}$)

A differential energy coefficient indicates a time difference of a sound strength. In this embodiment, it is clustered in 32 symbols as a 1-dimensional vector.

(4) Energy ($b_{ENERGY}$)

Energy is a coefficient indicating a sound strength. In this embodiment, it is clustered in 32 symbols as a 1-dimensional vector.

(5) Voiceness ($b_{VOICENESS}$)

Voiceness is a characteristic vector indicating a likeness of a voiced sound. It is clustered in 32 symbols as 2-dimensional vector featuring or characterizing a voice by a zero-cross rate and a pitch error. The zero-cross rate and the pitch error are described below, respectively.

(1) Zero-Cross Rate

The zero-cross rate is characterized by becoming lower as the voiceness increases, and it is defined by the following equation 9:

$$z_s(n) = \frac{1}{N}\sum_{m=n-M+1}^{n}\frac{|\mathrm{sgn}\{x(m)\} - \mathrm{sgn}\{x(m-1)\}|}{2}w(n-m) \quad \text{[Eq. 9]}$$

where $$\mathrm{sgn}\{s(n)\} = +1 : s(n) >= 0,\ -1 : s(n) < 0,$$

N: Number of frame samples

W: Frame window s: Input signal (2) Pitch Error

A pitch error indicates a likeness of a voiced sound by obtaining two-way mismatch of an error from a predicted pitch to a measured pitch and another error from a measured pitch to a predicted pitch. For further details, there is a description as a two-way mismatch technique in "Fundamental Frequency Estimation in the SMS Analysis" (P. Cano. Proceedings of the Digital Audio Effects Workshop, 1998).

First, a pitch error from a predicted pitch (p) to a measured pitch (m) is expressed by the following equation 10:

$$Err_{p\to m} = \sum_{n=1}^{N} E_w(\Delta f_n, f_n, a_n, A_{\max}) = \sum_{n=1}^{N}\left\{\Delta f_n\cdot(f_n)^{-p} + \left(\frac{a_n}{A_{\max}}\right)\times[q\Delta f_n\cdot(f_n)^{-p} - r]\right\} \quad \text{[Eq. 10]}$$

fn: nth predicted peak frequency

Δfn: Difference between nth predicted peak frequency and measured peak frequency approximate to it $a_n$: nth measured amplitude Amax: Maximum amplitude On the other hand, a pitch error from the measured pitch (m) to a predicted pitch (p) is expressed by the following equation 11:

$$Err_{m\to p} = \sum_{k=1}^{N} E_w(\Delta f_k, f_k, a_k, A_{\max}) = \sum_{k=1}^{N}\left\{\Delta f_k\cdot(f_k)^{-p} + \left(\frac{a_k}{A_{\max}}\right)\times[q\Delta f_k\cdot(f_k)^{-p} - r]\right\} \quad \text{[Eq. 11]}$$

fk: kth predicted peak frequency

Δfk: Difference between kth predicted peak frequency and measured peak frequency approximate to it $a_k$: kth measured amplitude Amax: Maximum amplitude Therefore, a total error is as follows:

$$\mathrm{Err}_{total} = \mathrm{Err}_{p\to m}/N + \rho\mathrm{Err}_{m\to p}/K \quad \text{[Eq. 12]}$$

It is reported that p=0.5, q=1.4, and r=0.5 are experimentally optimum for almost all voices as constants.

[1-2-2. Code Book]

Figure 11:
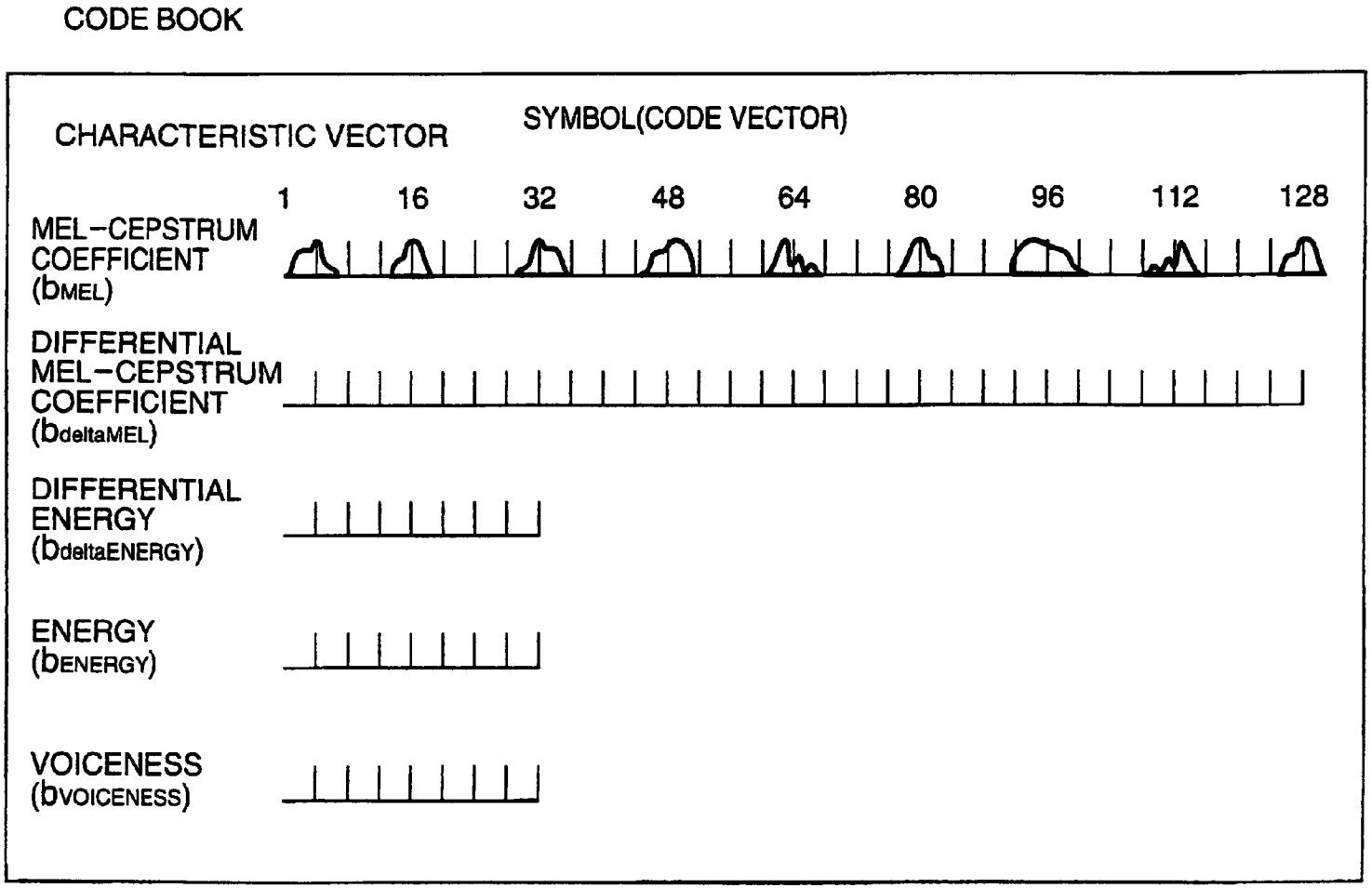
FIG. 11 is a diagram for in explaining a code book.

The code book stores vector information clustered into number of symbols for each characteristic vector (See FIG. 11). The code book is generated by finding out a set called K predicted vector (code) using quantization which secures the minimum distortion from all predicted vectors in a large amount of learning sets. In this embodiment, an LGB algorithm is used as an algorithm for clustering.

The LGB algorithm is described below.

(1) Initialization

First, a centroid is found from the entire vectors. It is considered to be an initial code vector here.

(2) Repetition

Supposing that I is a total repetition count, a code vector of $2^I$ is requested. Therefore, supposing that the repetition count is i=1, 2, - - - , I, the following calculation is made for the repetition i:

(1) Some existing code vectors x are divided into two codes, x(1+e) and x(1−e), where e is a small numeric value, for example, 0.001.

By this processing, $2^i$ new code vector $x^i_k$ (k=1, 2, - - - , $2^i$) are obtained.

(2) Regarding each predicted vector x in the learning sets, $x^i_k$ quantization is performed from x to a code.

$$k' = \mathrm{argmin}_k d(x, x^i_k)$$

where $d(x, x^i_k)$ indicates a distortion distance in a predicted space.

(3) During a repetition calculation, a calculation is performed for making all the vectors to be centroids for each k like $x^i_k = Q(x)$.

[1-2-3. Probability Data]

Next, probability data is described below. In this embodiment, PLU (phone-like unit) is used as a sub-word unit for modeling a voice. More specifically, as shown in FIG. 12, the Japanese language is supposed to be treated in units of 27 phonemes and number of states is allocated to each phoneme. The number of states is the number of the shortest frames during which a sub-word unit continues. For example, the phoneme "a" has a state count "3", and therefore it means that the phoneme "a" continues for at least 3 frames.

The three states represent a beginning of a pronunciation, a stationary state, and a release state as a typical model. A plosive such as phoneme "b" or "g" has originally a short phoneme, and therefore the plosive phoneme is set to number of states 2 and an aspiration is also set to number of states 2. Silence does not have a temporal fluctuation, and therefore set to number of states 1.

As shown in FIG. 13, as the probability data in the phonemic dictionary, a transition probability of each state and an observation symbol probability for symbols of each characteristic vector are prescribed for 27 phonemes represented in units of a sub-word. While a middle part is omitted in FIG. 13, the observation symbol probabilities for respective characteristic vectors sum up to 1. These parameters are obtained by estimating sub-word unit model parameters which maximize the likelihood of the models for learning data. A segmental k-means learning algorithm is used here. The segmental k-means learning algorithm is described below.

(1) Initialization

First, each phonemic segment is linearly segmented (divided) into HMM states regarding initial estimated data which has been previously phonemic-segmented.

(2) Estimation

The transition probability is obtained by counting a transition count (in units of a frame) used for a transition and then dividing it by a count value of the transition count (in units of a frame) used for all transitions from the state, as expressed by the following equation 13:

$$\hat{a}_{ij} = \frac{\text{Transition count from } S_i \text{ to } S_j}{\text{Transition count from } S_i} \quad \text{[Eq. 13]}$$

On the other hand, the observation symbol probability is obtained by counting the number of times of generating each characteristic symbol in each state and dividing it by a count of all the number of times of the observation in each state, as expressed by the following equation 14:

$$\hat{b}_j(O_k) = \frac{\text{Time count for characteristic symbol } O_k \text{ at } S_i}{\text{Time count at } S_j} \quad \text{[Eq. 14]}$$

(3) Segmentation

The leaning sets are segmented again in the Viterbi algorithm by using the estimated parameters obtained in step (2).

(4) Repetition

Steps (2) and (3) are repeated up to a convergence.

[1-3. Target Frame Information]

The target frame information retaining section 111 stores a voice of a target singer previously sampled and processed in the SMS analysis, in units of a frame.

First, referring to FIG. 14, the SMS analysis is described below. In the SMS analysis, a voice waveform (frame) obtained by multiplying a sampled voice waveform by a window function is cut out as a segment first, and then sinusoidal components and residual components are extracted from a frequency spectrum obtained by performing the fast Fourier transform (FFT).

A sinusoidal component is a frequency (overtone) component equivalent to a fundamental frequency (pitch) or a multiple of the fundamental frequency. In this embodiment, a fundamental frequency is retained as "Fi," an average amplitude of each component is retained as "Ai," and a spectrum envelope is retained as an envelope.

Figure 14:
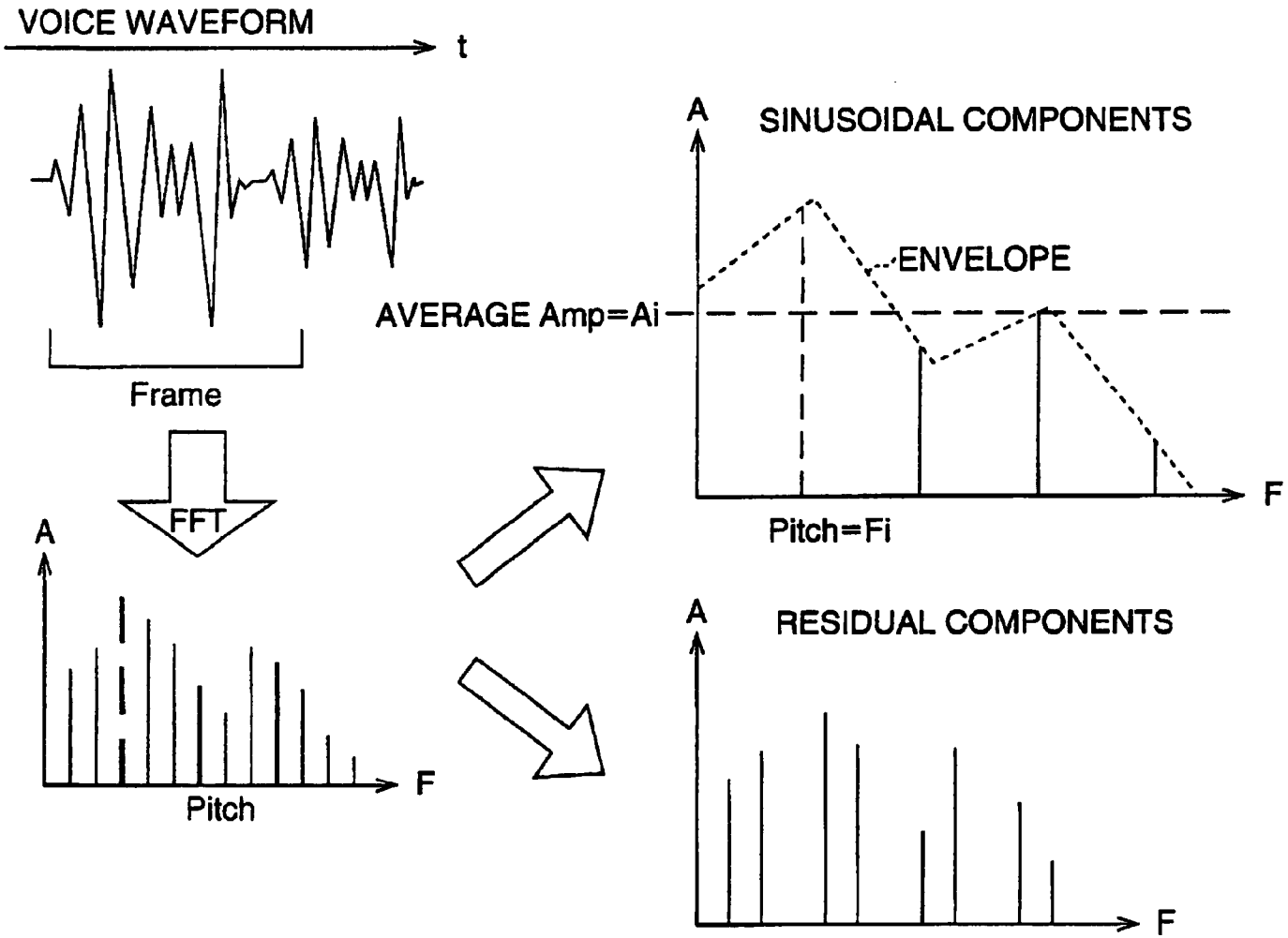
FIG. 14 is a diagram for explaining an SMS analysis.

A residual component is the remaining input signal from which the sinusoidal components are excluded, and the residual components are retained as frequency domain data as shown in FIG. 14 in this embodiment.

Figure 15:
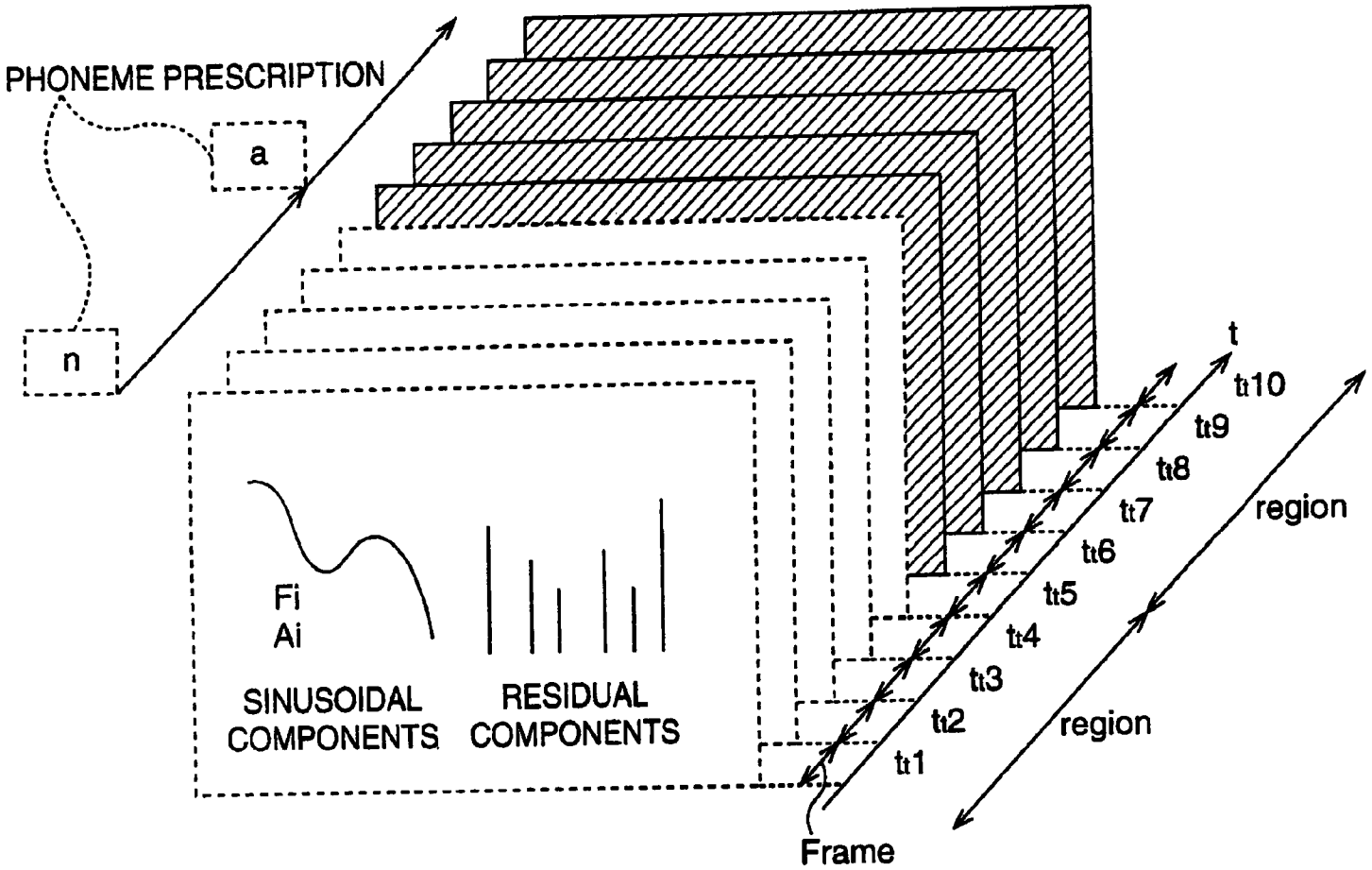
FIG. 15 is a diagram for explaining data of a target voice.

Frequency analysis data indicated by the sinusoidal components and residual components obtained as shown in FIG. 14 is stored in units of a fame as shown in FIG. 15. In this embodiment, a time interval between frames is assumed to be 5 ms, and the time can be specified by counting frames. Each frame has a time stamp being appended thereto equivalent to an elapsed time from the beginning of a music piece (tt1, tt2, - - - ).

As previously described, each phoneme continues for at least the number of frames corresponding to states set for each phoneme, and therefore each phonemic information is composed of a plurality of frames. This set of the multiple frames is referred to as a region.

The target frame information retaining section 111 stores phoneme sequences sampled when the target singer sings a song, and each phoneme is associated with a region in the script. In the example shown in FIG. 15, a region composed of frames tt1 to tt5 corresponds to phoneme "n" and another region composed of frames tt6 to tt10 corresponds to phoneme "a".

In this manner, by retaining target frame information and performing the same frame analysis for an input voice, the time can be specified when both are matched with each other in units of a phoneme, and synthesizing process can be performed with frequency analysis data.

2. Operation of the Embodiment

Next, the operation of this embodiment is described below.

[2-1. Outline Operation]

First, the outline operation is described below by referring to a flowchart shown in FIG. 16.

A microphone input voice analysis is performed, first (S1). Specifically, a fast Fourier transform is performed in units of a frame to retain frequency analysis data subjected to the SMS analysis from a frequency spectrum. In addition, the characteristic parameter analysis is performed from the frequency spectrum for symbol quantization based upon the phonemic dictionary.

Next, a state of the phoneme is determined using the HMM model based upon the phonemic dictionary and the phoneme sequence prescription (S2), and a state transition is determined in a 1-path Viterbi algorithm based upon the symbol-quantized characteristic parameter and the determined phonemic state (S3). The HMM model and the 1-path Viterbi algorithm are described later in detail.

Then, a time pointer of the input voice is determined based upon the determined state transition (S4), and it is judged whether or not the phonemic state is changed or updated at the corresponding time (S5). The time pointer specifies a frame at the corresponding processing time in a time series for the input voice and the target voice. In this embodiment, the input voice and the target voice are frequency-analyzed in units of a frame, and each frame is associated with the time series of the input voice and the target voice, respectively. Hereinafter, a time series for the input voice is denoted by time tm1, tm2, and so on, and another time series for the target voice is denoted by tt1, tt2, and so on.

If the phonemic state is judged to be updated or shifted in the judgement of step S5 (S5; Yes), frame counting is started (S6) and the time pointer is shifted to the beginning of the phoneme sequence (S7). The frame count denotes the number of frames processed as the corresponding phonemic state, and is a value indicating the number of frames having already been continued, because each phoneme continues for a plurality of frames as described above.

Subsequently the frequency analysis data of the input voice frame is synthesized with the frequency analysis data of the target voice frame in a frequency domain (S8), and a new voice signal is generated by an inverse fast Fourier transform (S9) for sound output.

If the phonemic state is judged not to be updated yet in the judgement in step S5 (S5; No), the frame count is incremented (S10), the time pointer is advanced by a frame time interval (S11), and the control progresses to step S8.

For describing this processing by a concrete example, the frame count is incremented if the phonemic state continuously remains "n" in the example shown in FIG. 15 to shift the time pointer tt1, tt2, and so on. If the phonemic state of the frame tt3 shifts to "a" at the time subsequent to the time for processing "n", the time pointer is shifted to the first frame tt6 for the phoneme sequence "a". By this processing, a time match in units of a phoneme is secured even if a pronunciation timing of the target signer differs from that of the karaoke singer.

[2-2. Details of Operation]

Next, each processing briefly described in the outline operation is described in detail below.

[2-2-1. Input Voice Analysis]

Figure 17:
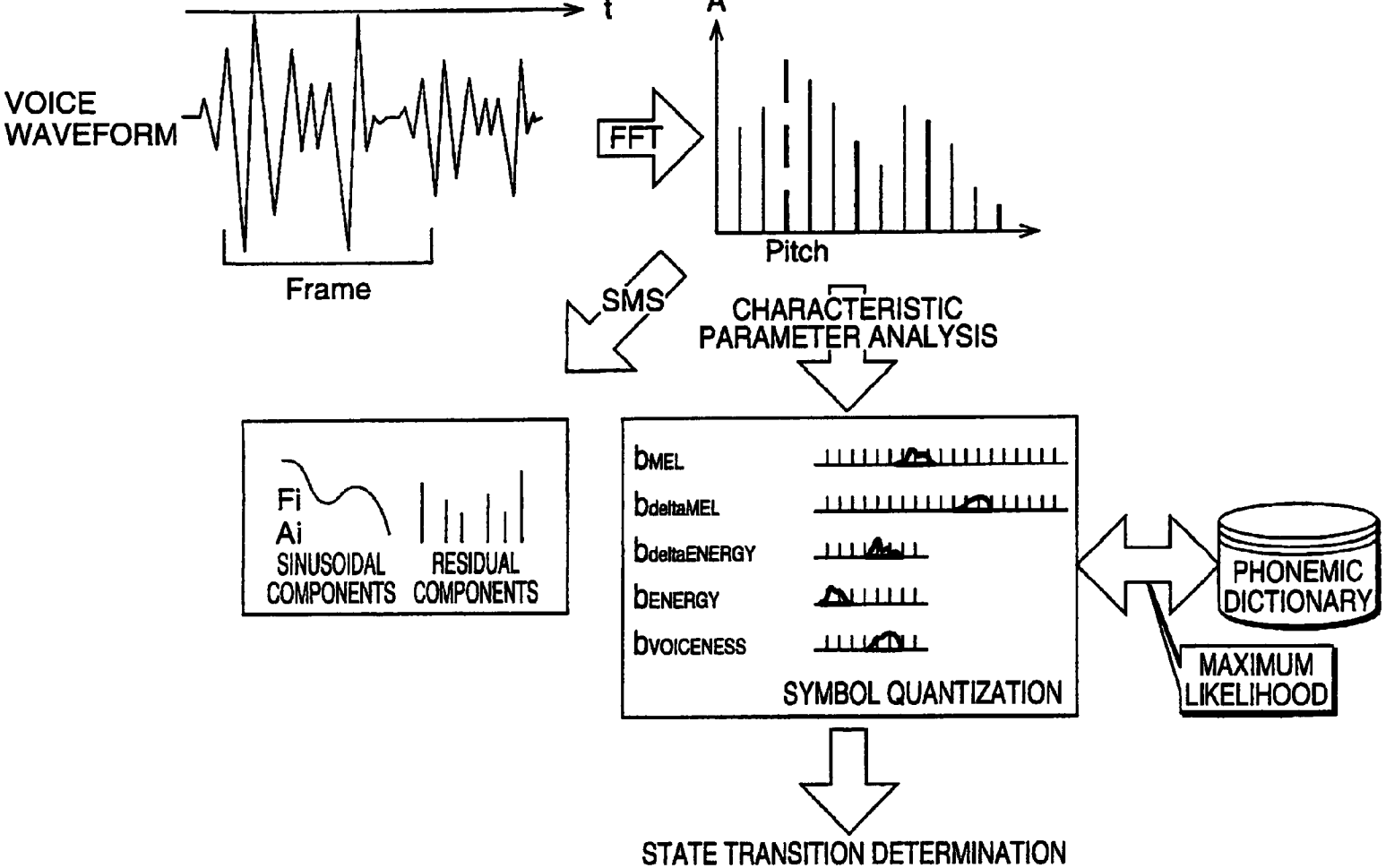
FIG. 17 is a diagram for explaining an input voice analysis.

Referring to FIG. 17, there is shown a diagram for explaining the process of analyzing an input voice in detail. As shown in FIG. 17, the voice signal segmented in units of a frame from the input voice waveform is converted to a frequency spectrum by the fast Fourier transform. The frequency spectrum is retained as frequency component data by the above-described SMS analysis and subjected to the characteristic parameter analysis.

On the other hand, the characteristic parameter analysis is performed for the frequency spectrum. More specifically, each characteristic vector is symbol-quantized by finding a symbol having the maximum likelihood out of the phonemic dictionary an observation symbol. By using the observation symbol for each frame obtained in this manner, a state transition is determined as described later in detail.

[2-2-2. Hidden Markov Model]

Figure 18:
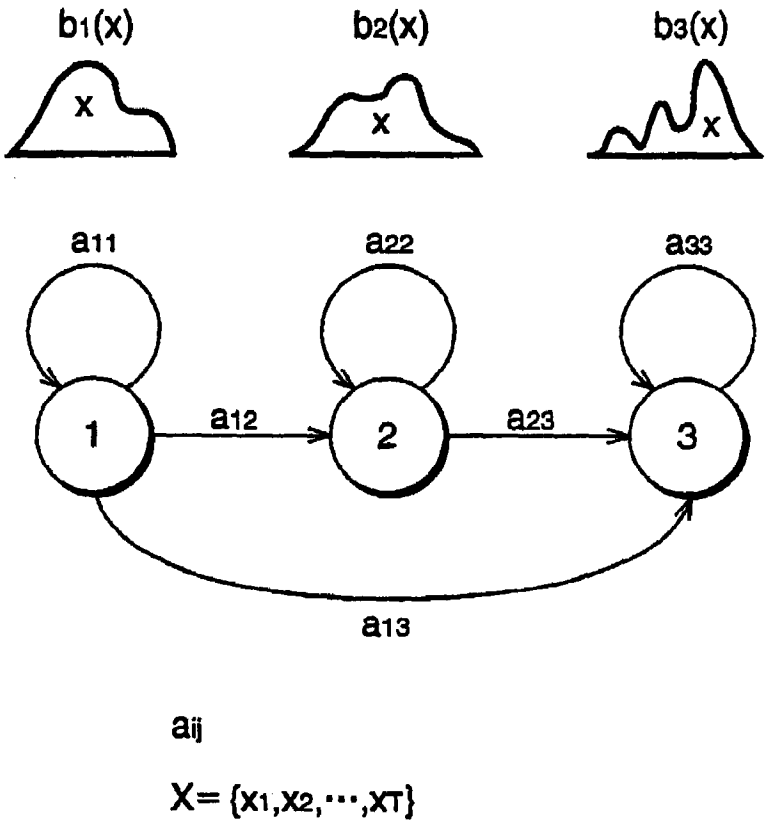
FIG. 18 is a diagram for explaining a hidden Markov model.

Next, by referring to FIG. 18, the hidden Markov model (HMM) will be described. Since the voice state shifts to a single direction, a left-to-right type model is used.

At time t, $a_{ij}$ designates a probability of a state transition from i to j (state transition probability). In the example shown in FIG. 18, $a_{11}$ designates a probability of remaining in state (1) and $a_{12}$ designates a probability of a transition from state (1) to state (2).

Each characteristic vector exists in each state, and has a different observation symbol. It is expressed by $X=\{x_1, x_2, ---, x_T\}$.

Additionally, $b_j(x_t)$ designates a probability of observating symbol $x_t$ of a characteristic vector when the state is j at time t (observation symbol discrete probability).

Supposing that a state sequence up to T is $Q=\{q_1, q_2, ---, q_T\}$ in model λ, a simultaneous generation probability of the observation symbol sequence X and the state sequence Q can be expressed as follows:

$$P(X, Q\backslash\lambda) = a_{q1q2}\prod_{t=1}^{T} b_{qt}(x_t)a_{qtq(t+1)} \quad \text{[Eq. 15]}$$

On the ground that the state sequence cannot be observed while the observation symbol sequence is known, this kind of model is called the hidden Markov model (HMM). In this embodiment, an FNS (finite state network) as shown in FIG. 18 is formed in units of a phoneme on the basis of the phoneme sequence prescription stored in the target frame information retaining section 111.

[2-2-3. Alignment]

Next, the temporal alignment in this embodiment will be described by referring to FIGS. 19 and 20. In this embodiment, the state transition of the input voice is determined by the 1-path Viterbi algorithm using the above hidden Markov model formed based upon the phoneme sequence prescription and the characteristic symbol in units of a frame extracted from the input voice. Then, a phoneme of the input voice is associated with a phoneme of the target voice frame by frame. Since the alignment of the two voice signals is used in the karaoke apparatus in this embodiment, a music piece based upon karaoke music piece data is synchronized with the voice signal. The above processing is sequentially described below.

[2-2-3-1. One Path Viterbi Algorithm]

The Viterbi algorithm is designed for calculating all probabilities of appearance of each observation symbol in the observation symbol sequence with each HMM model, and for selecting later a path to which the maximum probability is given as a state transition result. The state transition result is obtained after the completion of the observation symbol sequence. However, this is unsuitable for real-time processing. Therefore, the 1-path Viterbi algorithm described later is used to determine a current phonemic state.

$\Psi_t(j)$ in the equation below is given for selecting a state maximizing the best probability $\delta_t(i)$ in a frame at time t calculated based upon an observation up to the frame at time t and obtained via a single path. Namely, the phonemic state transits according to $\Psi_t(j)$.

Supposing $\delta_1(i)=1$ as an initial operation and the following arithmetic operation is performed as a repetitive operation:

$$\delta_t(j) = \max_{j-1<i<j}[\delta_{t-1}(i)a_{ij}]\cdot b_{j(MEL)}(O_t)\cdot b_{j(deltaMEL)}(O_t)\cdot b_{j(deltaENERGY)}(O_t)\cdot b_{j(VOICENESS)}(O_t)\cdot b_{j(ENERGY)}(O_t) \quad \text{[Eq. 16]}$$

$$1 \le t \le T,\ 1 \le j \le t$$

$$\Psi_t(j) = \arg\max_{j-1<i<j}[\delta_{t-1}(i)a_{ij}]$$

$$1 \le t \le T,\ 1 \le j \le t$$

where $a_{ij}$ designates a state transition probability from state i to state J, and N designates the maximum number of states allowed for states i and j depending upon the number of phonemes of the target music piece. In addition, $b_j(O_t)$ is an observation symbol probability of a characteristic vector at time t. Each observation symbol indicates a characteristic vector extracted from an input voice, and therefore an observation symbol depends upon a vocalization manner of the singer, and the transition mode also depends upon the vocalization manner.

Figure 19:
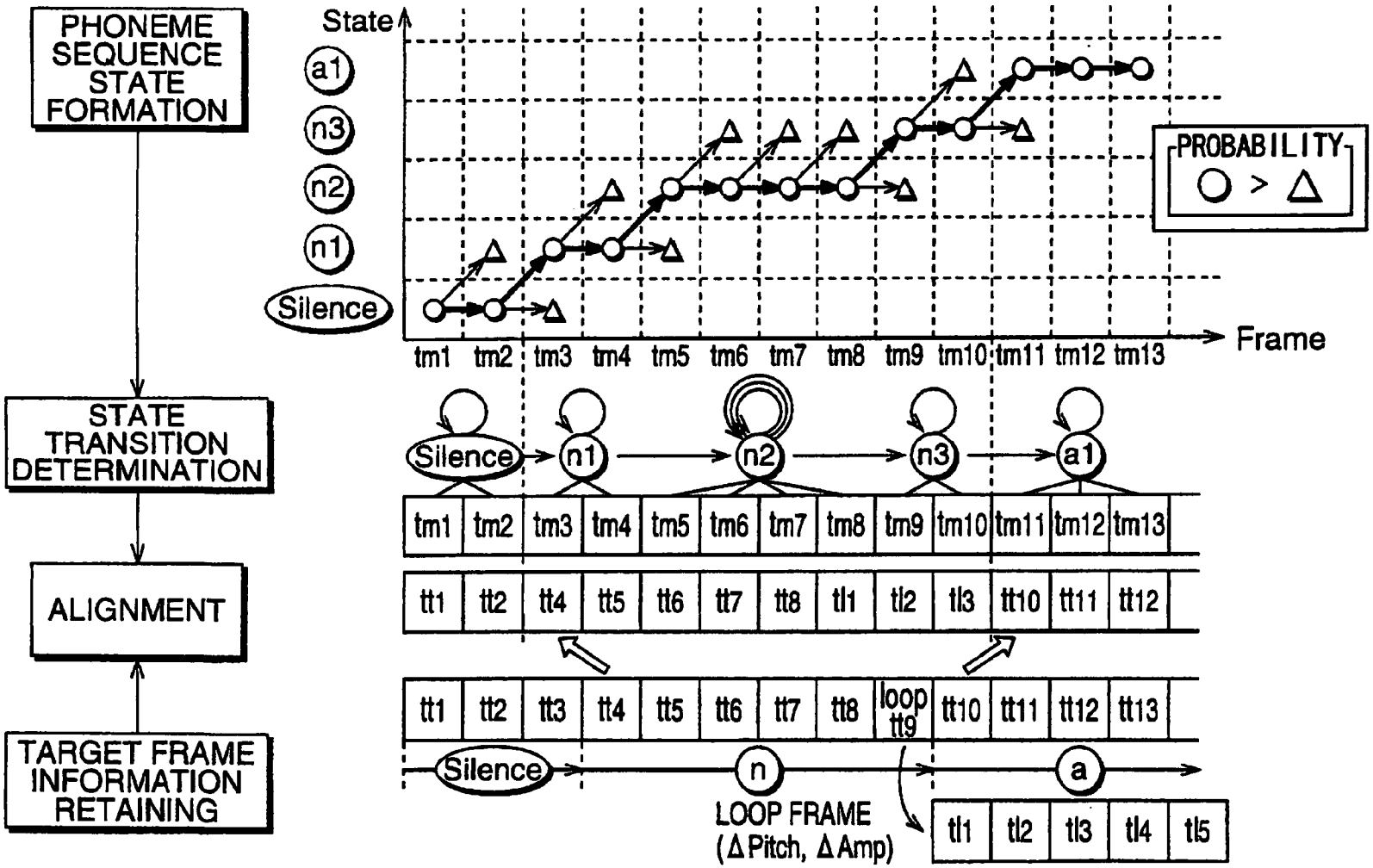
FIG. 19 is a diagram a concrete example of temporal alignment.

In the example shown in FIG. 19, a probability calculated by the above equation is indicated by mark ○ or Δ (○>Δ). For example, based upon the observation from time tm1 to time tm3, a probability of formation of a first path from state "silence" to state "n1" is higher than a probability of formation of a second path from sate "silence" to state "silence", and therefore the first path has the best probability at time tm3, by which the state transition is determined as indicated by a thick arrow in the diagram.

By performing this operation at each time corresponding to each frame of the input voice (tm1, tm2, - - - ), the state transition is determined in the example shown in FIG. 19 so as to determine a transition from state "silence" to state "n1" at time tm3, a transition from state "n1" to state "n2" at time tm5, a transition from state "n2" to state "n3" at time tm9, and a transition from state "n3" to state "a1" at time tm11. By this processing, a phoneme of the input voice can be specified at each time terms of a frames.

[2-2-3-2. Correspondence Frame by Frame]

After the state transition is determined and the phoneme of the input voice is specified in units of a frame as described in the above, frames are specified and allocated for the target voice corresponding to the determined phoneme.

As described above, each state of the hidden Markov model is formed based upon the phoneme sequence prescription of the target voice stored in the target frame information retaining section 111, hence frames can be specified for each phoneme of the target voice corresponding to each state.

In this embodiment, the matching process is performed in time series for each frame between the target voice and the input voice. In the example shown in FIG. 19, target frames at time tt1 to tt3 of the target voice correspond to phoneme "silence", frames at time tt4 to tt9 correspond to phoneme "n", and frames at time tt10 and after correspond to phoneme "a". On the other hand, the state transition of the input voice is determined by the 1-path Viterbi algorithm, so that the frames at time tm1 to tm2 of the input voice correspond to phoneme "silence," frames at time tm3 to tm10 correspond to phoneme "n," and frames at time tm11 and after correspond to phoneme "a."

Then, in corresponding to phoneme "silence," the frames at time tm1 of the input voice are matched to frames at time tt1 of the target voice, and frames at time tm2 of the input voice are matched to frames at time tt2 of the target voice. At time tm3 of the input voice, the state shifts from state "silence" to state "n1" and therefore the frame at time tm3 of the input voice becomes the first frame of phoneme "n". On the other hand, regarding the target voice, frames corresponding to phoneme "n" begin at time tt4 in the phoneme sequence prescription, and therefore a time pointer of the target voice at a start of pronunciation of the phoneme "n" is set to time tt4 (FIG. 16: See steps S5 to S7).

Figure 16:
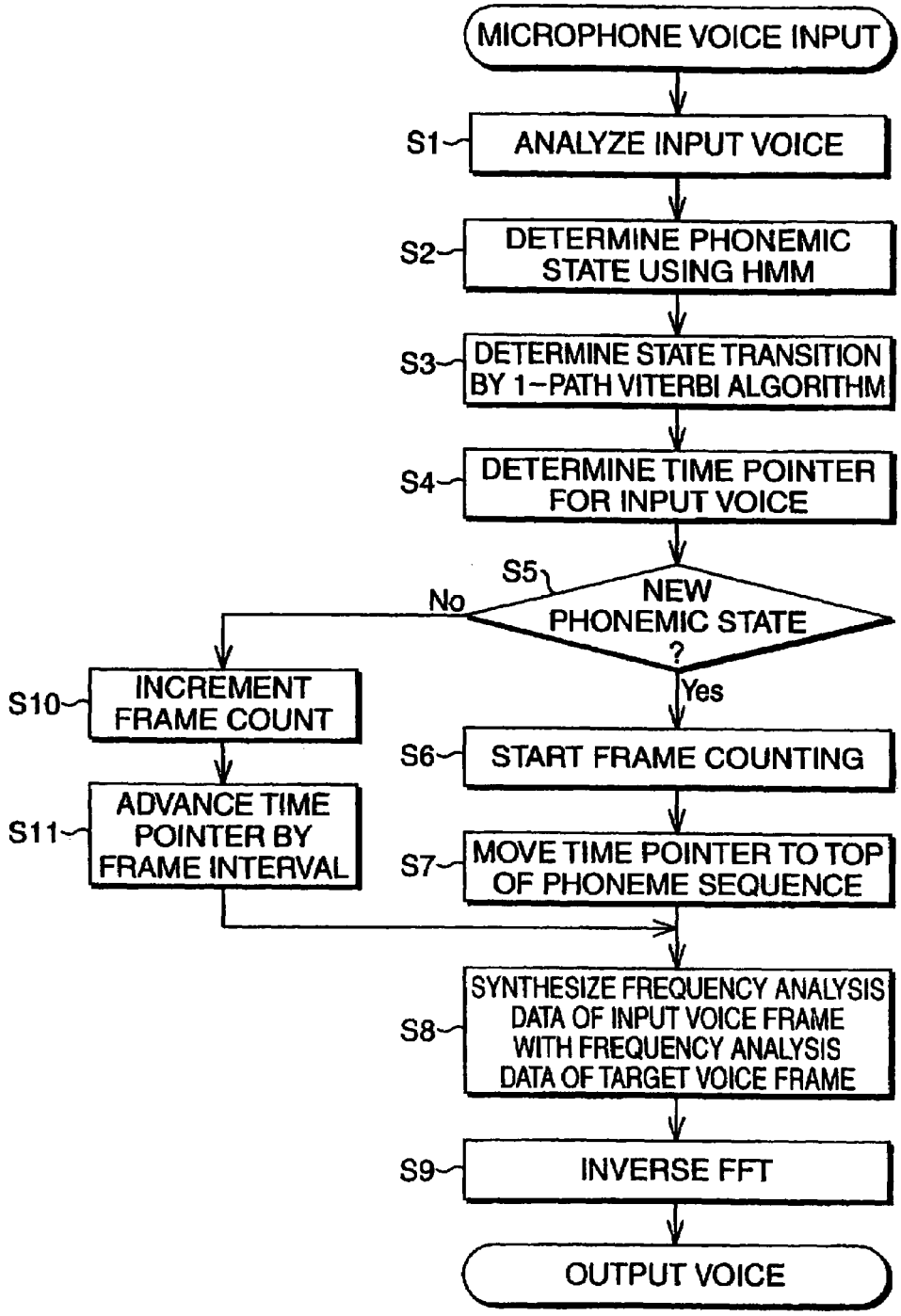
FIG. 16 is a flowchart for explaining an operation of the embodiment.

Next, the phonemic state does not shift to a new phonemic state at time tm4 of the input voice, and therefore the frame count is incremented and the time pointer of the target voice is advanced by frame a time interval (FIG. 16: See Steps S5 to S11), so that the frame at time tt5 is matched to the frame at time tm4 of the input voice. In this manner, the frames at time tm5 to tm7 of the input voice are sequentially matched to the frames at time tt6 to tt8 of the target voice.

In the example as shown in FIG. 19, 8 frames at time tm3 to tm10 of the input voice correspond to the phoneme "n," while frames corresponding to the phoneme "n" of the target voice are at time tt4 to tt9. A karaoke singer may pronounce the same phoneme for a longer period of time than a target singer as shown, hence previously prepared loop frames are used for interpolation in case that the target voice is shorter than the input voice.

The loop frames contain several frames of data for simulating and reproducing a change of a pitch or a change of an amplitude in elongating a voice for pronunciation, and the data comprises differences of fundamental frequencies (ΔPitchi) or differences of amplitudes (ΔAmp), for example.

Additionally, data for giving an instruction on calling a loop frame is provisionally written at the last frame of each phoneme in the phoneme sequence of the target frame data. By this prescription, even if the karaoke singer pronounces the same phoneme for a longer period of time than the target singer, favorable alignment can be achieved.

[2-2-3-3. Synchronization with Music Piece Data]

The voice conversion is applied to the karaoke apparatus in this embodiment, and the karaoke apparatus plays a music piece on the basis of MIDI data, and therefore it is desirable that the progress of a singing voice is synchronized with that of the music piece. Therefore, in this embodiment, the alignment section 110 is configured so that the time series indicated by the music piece data is synchronized with the phoneme sequence of the target voice. More specifically, as shown in FIG. 20, the sequencer 115 generates progress information of the music piece based upon time information prescribed in the music piece data (for example, Δ time or tempo information indicating reproduction time interval of MIDI data), and outputs the progress information to the alignment section 110.

The alignment section 110 compares the time information outputted from the sequencer 115 with the phoneme sequence prescription stored in the target frame information retaining section 111, and associates a time series of the music progress with that of the target voice.

Figure 20:
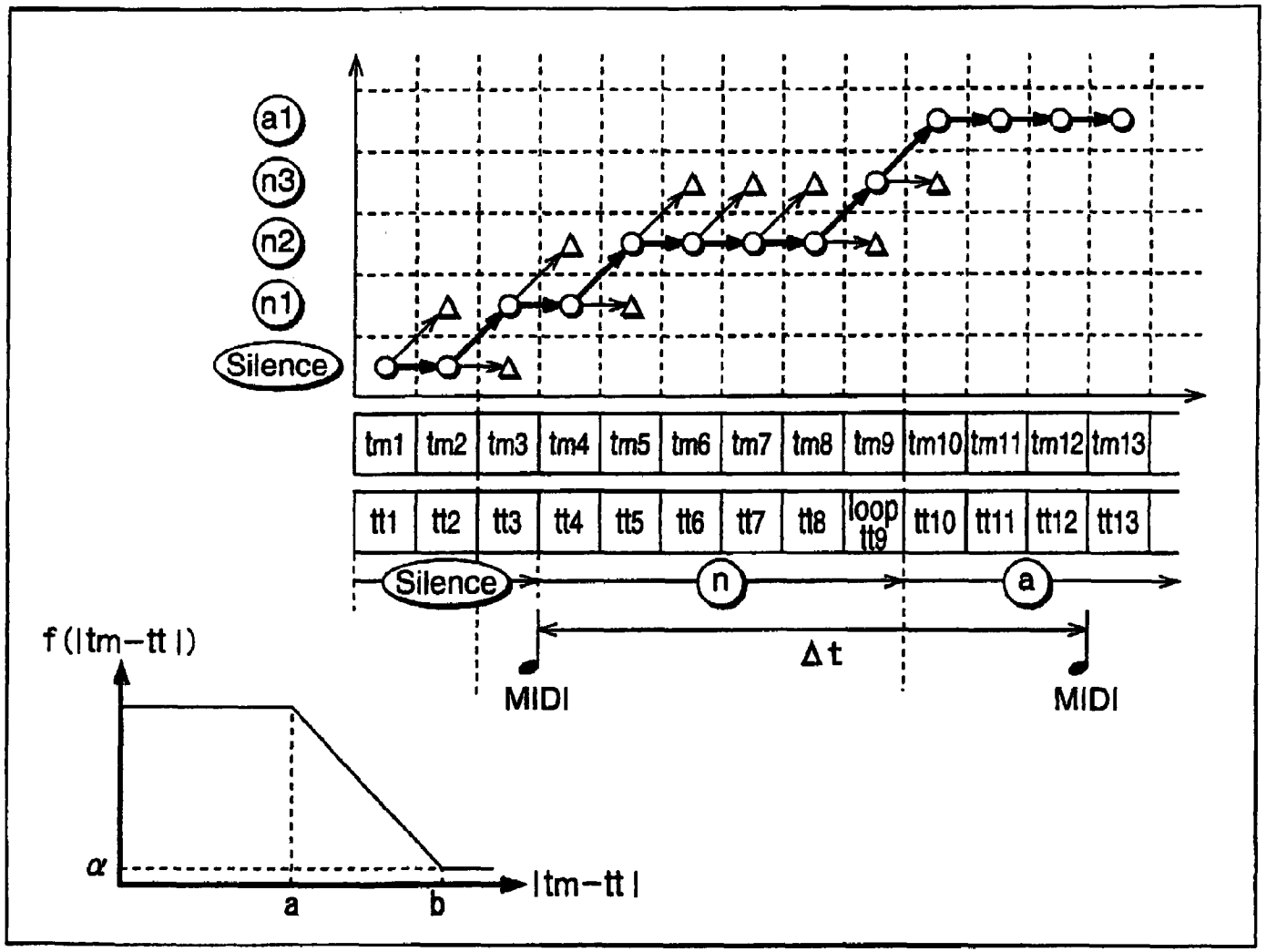
FIG. 20 is a diagram for explaining synchronization with a music piece.

In addition, by using a weight function $f(|t_m-t_t|)$ as shown in FIG. 20, the state transition probability can be weighted in synchronization with the music piece. This weighting function is a window function by which each state transition probability $a_{ij}$ is multiplied.

Reference characters a and b in FIG. 20 designate elements according to a tempo of the music piece. In addition, α is set to a value infinitely close to 0. The time pointer of the target voice progresses in synchronization with the tempo of the music piece as described above, and therefore the introduction of the weighting function causes the singing voice to be accurately synchronized with the target voice as a result.

[3. Alteration]

The present invention is not limited to the above described embodiments, and various alterations are possible as described below.

[3-1. Skipping Phoneme]

Figure 21:
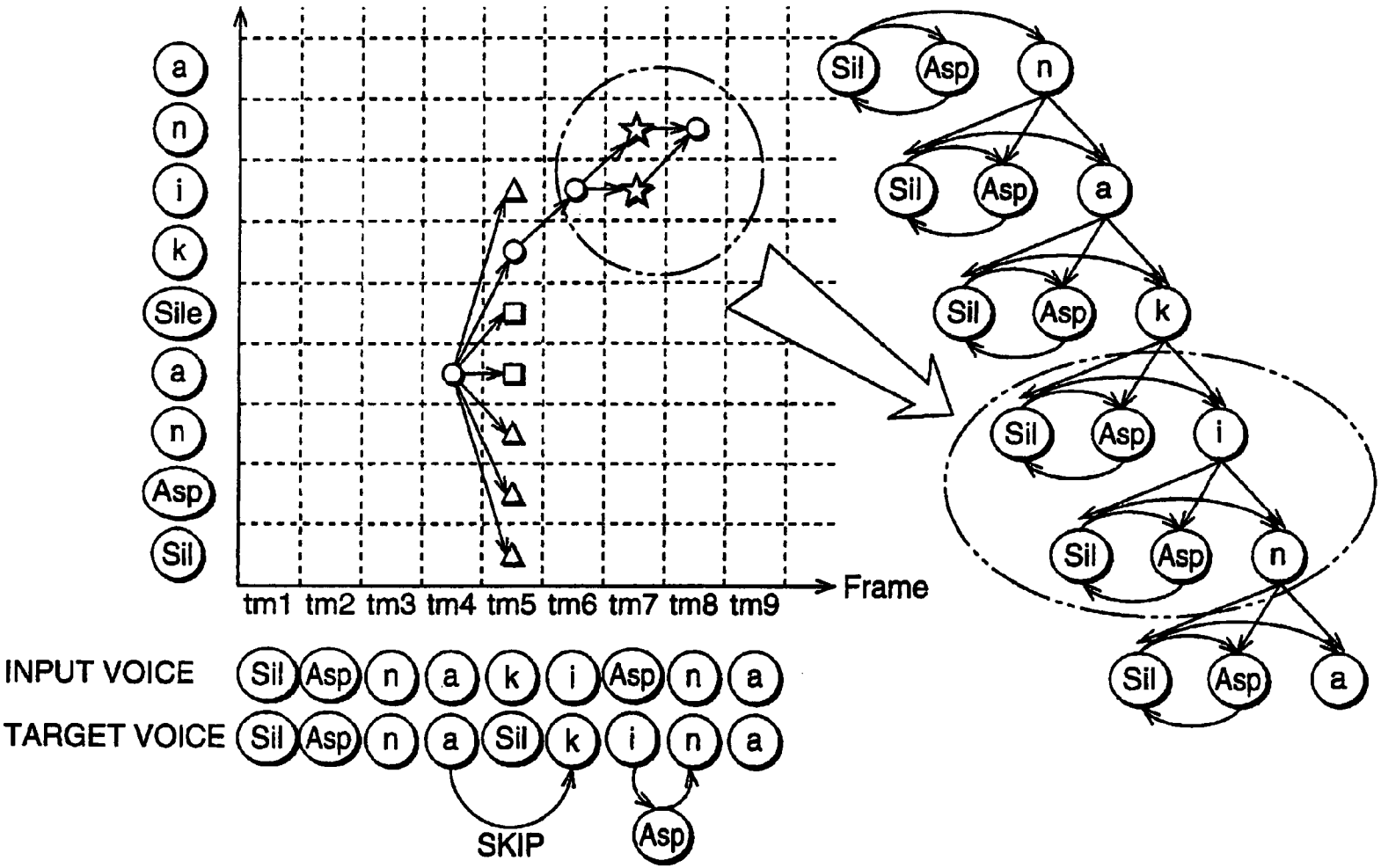
FIG. 21 is a diagram for explaining a state of skipping a phoneme.

While the state transition is determined by the 1-path Viterbi algorithm in the above embodiment, it is unsuitable if a karaoke singer makes a mistake in the words of a song. For example, there might be a condition where the singer sings several phrases ahead of or behind the correct ones in the words of the song. In this case, with a range for searching an optimum state being expanded to several states ahead or behind as shown in FIG. 21, frames can be skipped only when the state is judged to be optimum.

More specifically, the frame corresponds to the phoneme "a" at time tm4 of the input voice, and therefore in the above 1-path Viterbi algorithm, a higher probability is selected as the maximum probability from either of the probability of no transition from the phoneme "a" and the probability of a transition to "silence" subsequent to the phoneme "a" in the phoneme sequence prescription regarding the frame at time tm5 of the input voice. The singer, however, starts a pronunciation of phoneme "k" without a silence period, and therefore preferably the "silence" in the phoneme sequence prescription of the target is skipped for the temporal alignment. Therefore, if the singer vocalizes without following the phoneme sequence prescription of the target like this, it is possible to search for a state corresponding to the maximum probability up to several states ahead or behind. In the example shown in FIG. 21, three states around the last frame state is searched, and a transition to phoneme "k" at two states ahead is determined to the maximum probability. In this manner, the "silence" is skipped to determine a state transition to the phoneme "k".

In addition, there can be many conditions in which silence positions or aspiration positions deviate. In these conditions, the phonemic positions do not match in the above embodiment. Therefore, as shown in FIG. 21, the probabilities of skipping from a pronunciation phonemic unit to "silence" and "aspiration" or to another pronunciation phonemic unit are set in the same manner.

For example, there is no prescription of "aspiration" several states before and after the phoneme "i" in the phoneme sequence prescription of the target. It is, however, preferable to set equivalently a probability of a transition to phoneme "n" prescribed following phoneme "i" in the phoneme sequence prescription to another probability of skip to "silence" or "aspiration" which is not prescribed there and then returning to a phoneme in the phoneme sequence prescription after the skip to "silence" or "aspiration." By these settings, a flexible alignment can be achieved even if the singer takes a breath without following the phoneme sequence prescription of the target at time tm7 as shown in the example of FIG. 21, for example.

In addition, the input voice may shift from a certain fricative sound to another fricative sound independently of the phoneme sequence prescription of the target, and therefore the maximum probability can be searched for a fricative sound or the next phoneme in the phonemic description of the target voice in the alignment of fricative sounds.

[3-2. Similar Phonemes]

Figure 22:
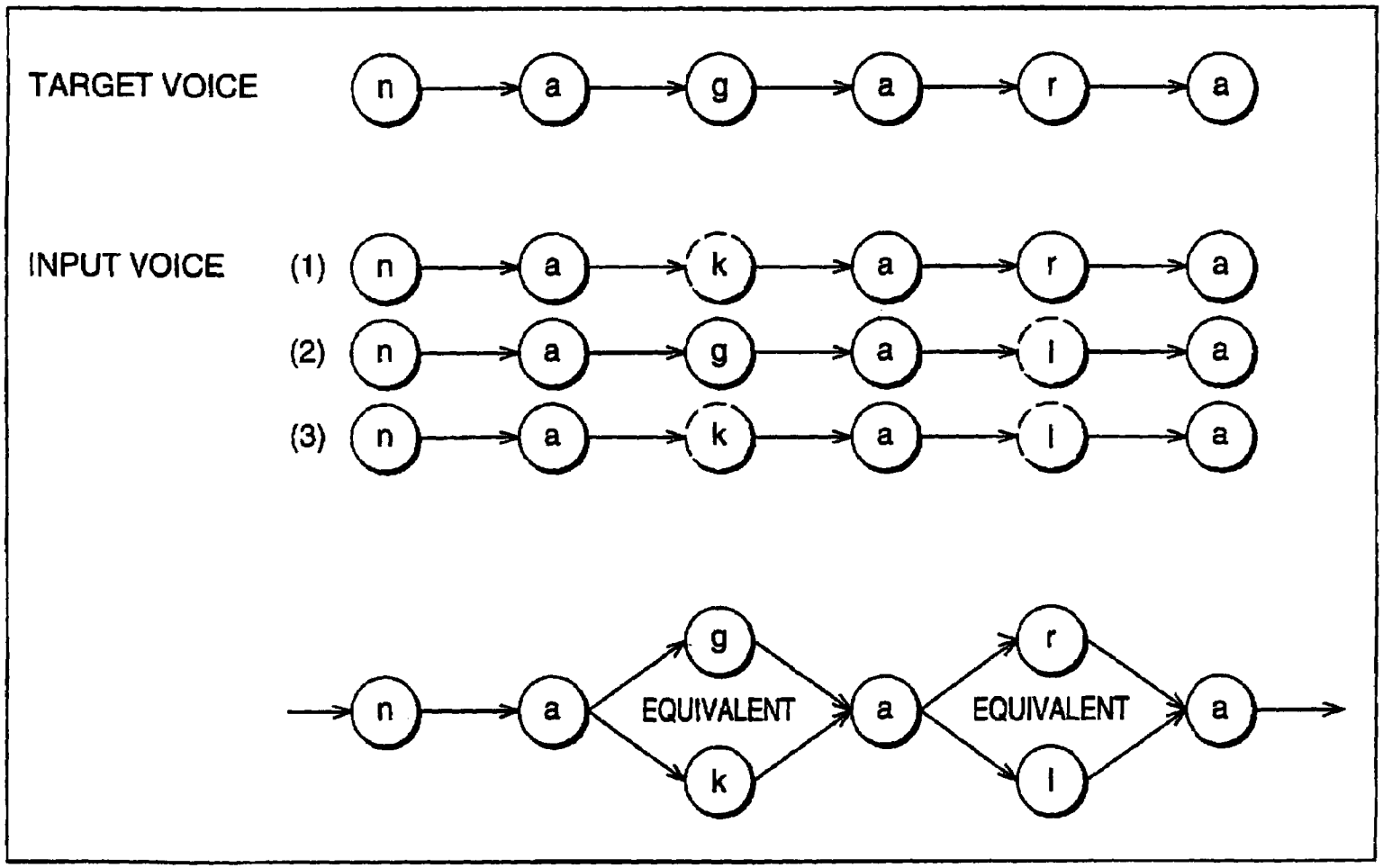
FIG. 22 is a diagram for explaining a case of pronouncing similar phonemes.

In Japanese language system, phonemes in a pronunciation may vary according to an individual singer for the same word. For example, as shown in FIG. 22, the singer may pronounce "nagara" in the phonemic prescription inaccurately such as "nakara," "nagala," or "nakala". Regarding similar phonemes like this, a flexible alignment can be realized by using a hidden Markov model having a grouped path as shown in FIG. 22.

[3-3. Others]

While a voice processing apparatus for associating in time series a target voice with an input voice, both of which are objects of alignment, is applied to a karaoke apparatus having an imitative function in the above embodiments, the present invention is not limited to this, but the invention can be used for scoring or correcting a singing performance. In addition, a technique of matching time series in units of a phoneme can be applied not only to a karaoke apparatus, but also to other apparatuses related to voice recognition.

While there are descriptions of a code book in which typical characteristic parameters of a voice signal are clustered into a predetermined number of symbols as characteristic vectors and a phonemic dictionary for storing a state transition probability and an observation probability of each of the above symbols for each phoneme in the above embodiment, parameters are not limited to the above five types of characteristic vectors, but other parameters can be used.

While the target voice and the input voice are frequency-analyzed in units of a frame in the above embodiment, the analysis method is not limited to the SMS analysis method described above, but they can be analyzed as waveform data in time domains. Otherwise, frequencies and waveforms can be used together for the analysis.

According to the present invention, an input voice of a singer can be assimilated to a voice of a target singer, and a capacity of analysis data of the target singer can be reduced to perform the real-time processing.

In addition, according to the present invention, it becomes possible to perform voice processing for associating in time series a target voice with an input voice, for the temporal alignment, using a small amount of storage capacity in the real-time processing.

What is claimed is:

1. An apparatus for temporally aligning a sequence of phonemes of a target voice represented by a time-series of frames with a sequence of phonemes of an input voice represented by a time-series of frames, the apparatus comprising:

a target storage section that stores a sequence of phonemes contained in the target voice, the sequence of the phonemes being obtained by provisionally analyzing the time-series of the frames of the target voice;

a phoneme storage section that stores a code book containing characteristic vectors representing characteristic parameters typical to phonemes, the characteristic vector being clustered into a number of symbols in the code book, and that stores a probability of a state transition from a first state to a second state of each phoneme and an observation probability of each symbol;

a quantizing section that analyzes the time-series of the frames of the input voice to extract therefrom the characteristic parameters, and that quantizes the characteristic parameters into observed code vectors which represent observed symbols of the input voice according to the code book stored in the phoneme storage section;

a state forming section that applies a hidden Markov model to the sequence of the phonemes of the target voice stored in the target storage section so as to estimate therefrom a time-series of states of the phonemes of the target voice based on the probability of the state transition from the first state to the second state of each phoneme and the observation probability of each symbol stored in the phoneme storage section;

a transition determining section that determines transitions of states occurring in the sequence of the phonemes of the input voice by a Viterbi algorithm based on the observed symbols of the input voice and the estimated time-series of the states of the phonemes of the target voice; and an aligning section that aligns the sequence of the phonemes of the target voice and the sequence of the phonemes of the input voice with each other according to the determined state transitions of the input voice.

2. The apparatus according to claim 1, wherein the code book contains a characteristic vector which characterizes a spectrum of a voice in terms of a mel-cepstrum coefficient.

3. The apparatus according to claim 1, wherein the code book contains a characteristic vector which characterizes a spectrum of a voice in terms of a differential mel-cepstrum coefficient.

4. The apparatus according to claim 1, wherein the code book contains a characteristic vector which characterizes a voice in terms of a differential energy coefficient.

5. The apparatus according to claim 1, wherein the code book contains a characteristic vector which characterizes a voice in terms of an energy.

6. The apparatus according to claim 1, wherein the code book contains a characteristic vector which characterizes a voice in terms of a zero-cross rate and a pitch error observed in a waveform of the voice.

7. The apparatus according to claim 1, wherein the phoneme storage section stores the code book produced by quantization of predicted vectors of a given learning set using an algorithm for clustering.

8. The apparatus according to claim 1, wherein the phoneme storage section stores the probability of the state transition from the first state to the second state and the observation probability of each symbol with respect to the characteristic vector of each phoneme, the characteristic vector being obtained by estimating characteristic parameters maximizing a likelihood of a model for learning data.

9. The apparatus according to claim 1, wherein the transition determining section searches for an optimal state among a number of states around a current state of the estimated time-series of the states so as to determine a transition from the current state to the optimal state occurring in the sequence of the phonemes of the input voice.

10. The apparatus according to claim 1, wherein the state forming section estimates the time-series of states of the phonemes of the target voice such that the time-series of states contains a pass from one state of one phoneme to another state of another phoneme and an alternative pass from one state to another state via a silent state or an aspiration state.

11. The apparatus according to claim 1, wherein the state forming section estimates the time-series of states of the phonemes of the target voice such that the time-series of states contains parallel passes from one state of one phoneme to another state of another phoneme via different states of similar phonemes having equivalent transition probabilities.

12. The apparatus according to claim 1, wherein the aligning section aligns the sequence of the phonemes of the target voice and the sequence of the phonemes of the input voice with each other such that each phoneme has a region containing a variable number of frames and such that the number of frames contained in each region of each phoneme can be adjusted for the aligning of the target voice with the input voice.

13. The apparatus according to claim 12, wherein the aligning section operates when a number of frames contained in a region of a phoneme of the input voice is greater than a number of frames contained in a corresponding region of the same phoneme of the target voice for adding a provisionally stored frame into the corresponding region, thereby expanding the corresponding region of the target voice in alignment with the region of the input voice.

14. The apparatus according to claim 12, wherein the aligning section operates when a number of frames contained in a region of a phoneme of the input voice is smaller than a number of frames contained in a corresponding region of the same phoneme of the target voice for deleting one or more frame from the corresponding region, thereby compressing the corresponding region of the target voice in alignment with the region of the input voice.

15. The apparatus according to claim 1, wherein the transition determining section operates when determining a transition from a current state of a fricative phoneme for evaluating both of a transition probability to another state of another fricative phoneme and a transition probability to another state of a next phoneme of the target voice.

16. The apparatus according to claim 1, further comprising a synthesizing section that synthesizes the frames of the input voice and the frames of the target voice with each other synchronously by a frame to a frame after the input voice and the target voice are temporally aligned with each other.

17. The apparatus according to claim 16, further comprising an analyzing section that analyzes each frame of the input voice to extract therefrom sinusoidal components and residual components contained in each frame, wherein the target storage section stores the frames of the target voice such that each frame contains sinusoidal components and residual components provisionally extracted from the target voice, and wherein the synthesizing section mixes the sinusoidal components or the residual components of the input voice and the sinusoidal components or the residual components of the target voice with each other at a predetermined ratio at each frame.

18. The apparatus according to claim 17, further comprising a waveform generating section for applying an inverse Fourier transform to the mixed sinusoidal components and the residual components so as to generate a waveform of a synthesized voice.

19. The apparatus according to claim 1, further comprising a music storage section that stores music data representative of a karaoke music piece, a reproducing section that reproduces the karaoke music piece according to the stored music data, a synchronizing section that synchronizes the time-series of the frames of the target voice sampled from a model singer with a temporal progress of the karaoke music piece, a synthesizing section that synthesizes the frames of the input voice of a karaoke player and the frames of the target voice of the model singer with each other synchronously by a frame to a frame after the input voice and the target voice are temporally aligned with each other to form a time-series of an output voice, and a sounding section that sounds the output voice along with the karaoke music piece.

20. The apparatus according to claim 1, wherein the transition determining section weighs the probability of the state transition from the first state to the second state of each phoneme in synchronization with the temporal progress of the karaoke music piece when the transition determining section determines transitions of states occurring in the sequence of the phonemes of the input voice.

21. A method of temporally aligning a sequence of phonemes of a target voice represented by a time-series of frames with a sequence of phonemes of an input voice represented by a time-series of frames, the method comprising:

a target storing step of storing a sequence of phonemes contained in the target voice, the sequence of the phonemes being obtained by provisionally analyzing the time-series of the frames of the target voice;

a phoneme storing step of storing a code book containing characteristic vectors representing characteristic parameters typical to phonemes, the characteristic vector being clustered into a number of symbols in the code book, and storing a probability of a state transition from a first state to a second state of each phoneme and an observation probability of each symbol;

a quantizing step of analyzing the time-series of the frames of the input voice to extract therefrom the characteristic parameters, and quantizing the characteristic parameters into observed code vectors which represent observed symbols of the input voice according to the code book stored in the phoneme storing step;

a state forming step of applying a hidden Markov model to the sequence of the phonemes of the target voice stored in the target storing step so as to estimate therefrom a time-series of states of the phonemes of the target voice based on the probability of the state transition from the first state to the second state of each phoneme and the observation probability of each symbol stored in the phoneme storing step;

a transition determining step of determining transitions of states occurring in the sequence of the phonemes of the input voice by a Viterbi algorithm based on the observed symbols of the input voice and the estimated time-series of the states of the phonemes of the target voice; and an aligning step of aligning the sequence of the phonemes of the target voice and the sequence of the phonemes of the input voice with each other according to the determined state transitions of the input voice.

22. The method according to claim 21, wherein the phoneme storing step stores the code book containing a characteristic Vector which characterizes a spectrum of a voice in terms of a mel-cepstrum coefficient.

23. The method according to claim 21, wherein the phoneme storing step stores the code book containing a characteristic vector which characterizes a spectrum of a voice in terms of a differential mel-cepstrum coefficient.

24. The method according to claim 21, wherein the phoneme storing step stores the code book containing a characteristic vector which characterizes a voice in terms of a differential energy coefficient.

25. The method according to claim 21, wherein the phoneme storing step stores the code book containing a characteristic vector which characterizes a voice in terms of an energy.

26. The method according to claim 21, wherein the phoneme storing step stores the code book containing a characteristic vector which characterizes a voiceness of a voice in terms of a zero-cross rate and a pitch error observed in a waveform of the voice.

27. The method according to claim 21, wherein the phoneme storing step stores the code book produced by quantization of predicted vectors of a given learning set using an algorithm for clustering.

28. The method according to claim 21, wherein the phoneme storing step stores the probability of the state transition from the first state to the second state and the observation probability of each symbol with respect to the characteristic vector of each phoneme, the characteristic vector being obtained by estimating characteristic parameters maximizing a likelihood of a model for learning data.

29. The method according to claim 21, wherein the transition determining step searches for an optimal state among a number of states around a current state of the estimated time-series of the states so as to determine a transition from the current state to the optimal state occurring in the sequence of the phonemes of the input voice.

30. The method according to claim 21, wherein the state forming step estimates the time-series of states of the phonemes of the target voice such that the time-series of states contains a pass from one state of one phoneme to another state of another phoneme and an alternative pass from one state to another state via a silent state or an aspiration state.

31. The method according to claim 21, wherein the state forming step estimates the time-series of states of the phonemes of the target voice such that the time-series of states contains parallel passes from one state of one phoneme to another state of another phoneme via different states of similar phonemes having equivalent transition probabilities.

32. The method according to claim 21, wherein the aligning step aligns the sequence of the phonemes of the target voice and the sequence of the phonemes of the input voice with each other such that each phoneme has a region containing a variable number of frames and such that the number of frames contained in each region of each phoneme can be adjusted for the aligning of the target voice with the input voice.

33. The method according to claim 32, wherein the aligning step is carried out when a number of frames contained in a region of a phoneme of the input voice is greater than a number of frames contained in a corresponding region of the same phoneme of the target voice, for adding a provisionally stored frame into the corresponding region, thereby expanding the corresponding region of the target voice in alignment with the region of the input voice.

34. The method according to claim 32, wherein the aligning step is carried out when a number of frames contained in a region of a phoneme of the input voice is smaller than a number of frames contained in a corresponding region of the same phoneme of the target voice, for deleting one or more frame from the corresponding region, thereby compressing the corresponding region of the target voice in alignment with the region of the input voice.

35. The method according to claim 21, wherein the transition determining step is carried out, when determining a transition from a current state of a fricative phoneme, for evaluating both of a transition probability to another state of another fricative phoneme and a transition probability to another state of a next phoneme of the target voice.

36. The method according to claim 21, further comprising a synthesizing step of synthesizing the frames of the input voice and the frames of the target voice with each other synchronously by a frame to a frame after the input voice and the target voice are temporally aligned with each other.

37. The method according to claim 36, further comprising an analyzing step of analyzing each frame of the input voice to extract therefrom sinusoidal components and residual components contained in each frame, wherein the target storing step stores the frames of the target voice such that each frame contains sinusoidal components and residual components provisionally extracted from the target voice, and wherein the synthesizing step mixes the sinusoidal components or the residual components of the input voice and the sinusoidal components or the residual components of the target voice with each other at a predetermined ratio at each frame.

38. The method according to claim 37, further comprising a waveform generating step of applying an inverse Fourier transform to the mixed sinusoidal components and the residual components so as to generate a waveform of a synthesized voice.

39. The method according to claim 21, further comprising a music storing step of storing music data representative of a karaoke music piece, a reproducing step of reproducing the karaoke music piece according to the stored music data, a synchronizing step of synchronizing the time-series of the frames of the target voice sampled from a model singer with a temporal progress of the karaoke music piece, a synthesizing step of synthesizing the frames of the input voice of a karaoke player and the frames of the target voice of the model singer with each other synchronously by a frame to a frame after the input voice and the target voice are temporally aligned with each other to form a time-series of an output voice, and a sounding step of sounding the output voice along with the karaoke music piece.

40. The method according to claim 39, wherein the transition determining step weighs the probability of the state transition from the first state to the second state of each phoneme in synchronization with the temporal progress of the karaoke music piece when the transition determining step determines transitions of states occurring in the sequence of the phonemes of the input voice.

41. A machine readable medium for use in an apparatus having a CPU for temporally aligning a sequence of phonemes of a target voice represented by a time-series of frames with a sequence of phonemes of an input voice represented by a time-series of frames, wherein the medium contains program instructions executable by the CPU for causing the apparatus to perform a process comprising:

a target storing step of storing a sequence of phonemes contained in the target voice, the sequence of the phonemes being obtained by provisionally analyzing the time-series of the frames of the target voice;

a phoneme storing step of storing a code book containing characteristic vectors representing characteristic parameters typical to phonemes, the characteristic vector being clustered into a number of symbols in the code book, and storing a probability of a state transition from a first state to a second state of each phoneme and an observation probability of each symbol;

a quantizing step of analyzing the time-series of the frames of the input voice to extract therefrom the characteristic parameters, and quantizing the characteristic parameters into observed code vectors which represent observed symbols of the input voice according to the code book stored in the phoneme storing step;

a state forming step of applying a hidden Markov model to the sequence of the phonemes of the target voice stored in the target storing step so as to estimate therefrom a time-series of states of the phonemes of the target voice based on the probability of the state transition from the first state to the second state of each phoneme and the observation probability of each symbol stored in the phoneme storing step;

a transition determining step of determining transitions of states occurring in the sequence of the phonemes of the input voice by a Viterbi algorithm based on the observed symbols of the input voice and the estimated time-series of the states of the phonemes of the target voice; and an aligning step of aligning the sequence of the phonemes of the target voice and the sequence of the phonemes of the input voice with each other according to the determined state transitions of the input voice.

* * * * *